US009243843B2

(12) United States Patent
Savarese

(10) Patent No.: US 9,243,843 B2
(45) Date of Patent: Jan. 26, 2016

(54) DRYING APPARATUS AND METHODS

(75) Inventor: Mark Savarese, Dallesport, WA (US)

(73) Assignee: Columbia PhytoTechnology, LLC, The Dalles, OR (US)

( * ) Notice: Subject to any disclaimer, the term of this patent is extended or adjusted under 35 U.S.C. 154(b) by 815 days.

(21) Appl. No.: 13/323,657

(22) Filed: Dec. 12, 2011

(65) Prior Publication Data

US 2012/0151790 A1 Jun. 21, 2012

Related U.S. Application Data

(60) Provisional application No. 61/422,076, filed on Dec. 10, 2010.

(51) Int. Cl.

| | |
|---|---|
| ***F26B 3/34*** | (2006.01) |
| ***F26B 17/02*** | (2006.01) |
| ***F26B 3/30*** | (2006.01) |

(52) U.S. Cl.

CPC ..... *F26B 17/023* (2013.01); *F26B 3/30* (2013.01)

(58) Field of Classification Search

CPC ..... F26B 3/30; F26B 17/023
USPC ..... 34/266, 268, 269, 273, 418–422
See application file for complete search history.

(56) References Cited

U.S. PATENT DOCUMENTS

| | | | | |
|---|---|---|---|---|
| 2,400,460 A | | 5/1946 | Hall | |
| 2,846,319 A | * | 8/1958 | Kelly | 426/242 |
| 3,364,587 A | * | 1/1968 | Norton et al. | 34/549 |
| 4,033,263 A | * | 7/1977 | Richmond | 101/424.1 |
| 4,631,837 A | * | 12/1986 | Magoon | 34/353 |
| 5,382,441 A | | 1/1995 | Lentz et al. | |
| 5,557,858 A | | 9/1996 | Macaluso et al. | |
| 5,974,688 A | | 11/1999 | Domingue et al. | |
| 6,393,730 B1 | | 5/2002 | Suzuki | |
| 6,401,358 B1 | * | 6/2002 | Bar et al. | 34/266 |
| 6,539,645 B2 | | 4/2003 | Savarese | |

(Continued)

FOREIGN PATENT DOCUMENTS

| | | |
|---|---|---|
| CN | 2044339 U | 9/1989 |
| CN | 2138280 Y | 7/1993 |

(Continued)

OTHER PUBLICATIONS

International Search Report and Written Opinion of the International Searching Authority, mailed Mar. 29, 2012, for corresponding International Application No. PCT/US2011/064498, 9 pages.

(Continued)

*Primary Examiner* — Kenneth Rinehart
*Assistant Examiner* — Gajanan M Prabhu
(74) *Attorney, Agent, or Firm* — Klarquist Sparkman, LLP

(57) ABSTRACT

The present disclosure concerns a drying or heating apparatus that is capable of independently controlling the temperature of the product being heated (e.g., to achieve a desired temperature profile) and the wavelength of the radiation (e.g., to maximize the heat transfer rate). To such ends, a drying apparatus can be provided with one or more heat sources that are movable relative to the product being heated in order to increase or decrease the gap or spacing between the heat source and the product. By adjusting the gap between the product and the heat source, it is possible to control the source temperature in such a manner that produces the desired product temperature and wavelength of radiation.

16 Claims, 17 Drawing Sheets

(56) References Cited

U.S. PATENT DOCUMENTS

| | | | | |
|---|---|---|---|---|
| 6,851,559 | B2 | 2/2005 | Kairi | |
| 6,858,261 | B1 | 2/2005 | Bär et al. | |
| 7,344,322 | B2 | 3/2008 | Hayashi et al. | |
| 7,441,344 | B1 * | 10/2008 | Savarese | 34/268 |
| 2003/0150128 | A1 | 8/2003 | Macaluso et al. | |
| 2008/0178491 | A1 | 7/2008 | Savarese | |
| 2012/0110869 | A1 * | 5/2012 | Bellinger et al. | 34/427 |

FOREIGN PATENT DOCUMENTS

| | | | |
|---|---|---|---|
| CN | 2604248 | Y | 2/2004 |
| CN | 1510998 | A | 7/2004 |
| GB | 2072821 | A | 10/1981 |
| KR | 1020090077362 | A | 7/2009 |
| WO | WO91/13667 | A1 | 9/1991 |

OTHER PUBLICATIONS http://www.infraredheaters.com/fundamen.htm, "Fundamentals of Infrared," InfraredHeaters.com, 9 pages, retrieved Nov. 17, 2010.

http://www.noblelight.net/resources/infrared_case_studies/drying_of_water_based_coatings.shtml, "Case Study: Infrared (IR) Drying of Water-Based Coatings," Heraeus Noblelight, 3 pages, retrieved Nov. 17, 2010.

State Intellectual Property Office of the People's Republic of China, First Office Action (including English Translation) for China Application No. 201180066846X, dated Sep. 25, 2014 (27 pages).

State Intellectual Property Office of the People's Republic of China, Second Office Action and Search Report (including English Translation) for Chinese Application No. 201180066846X, dated Jun. 19, 2014 (41 pages).

"Communication—Extended European Search Report" from the European Patent Office for European Application No. EP11847707.4-1605, dated Apr. 16, 2015, 7 pages.

* cited by examiner

DRYING APPARATUS AND METHODS

CROSS REFERENCE TO RELATED APPLICATION

The present application claims the benefit of U.S. Provisional Application No. 61/422,076, filed Dec. 10, 2010, which is incorporated herein by reference.

FIELD

The present invention relates to methods and apparatus for drying a product, and more specifically, to methods and apparatus for drying a product which is in the form of a liquid or paste by removing moisture therefrom.

BACKGROUND

Prior art drying apparatus and methods have been utilized for drying organic products which are in the form of liquids or semi-liquids such as solutions and colloidal suspensions and the like. These prior art drying apparatus have been used primarily to produce various dried or concentrated foodstuffs and food-related products, as well as nutritional supplements and pharmaceuticals. The liquid products are usually first processed in a concentrator apparatus which employs a high-capacity heat source, such as steam or the like, to initially remove a portion of the moisture from the suspension. Then, the concentrated products are often processed in a prior art drying apparatus in order to remove a further portion of the remaining moisture.

Various types of prior art drying apparatus have been employed, including spray dryers and freeze dryers. While spray dryers are known to provide high processing capacity at a relatively low production cost, the resulting product quality is known to be relatively low. On the other hand, freeze dryers are known to produce products of high quality, but at a relatively high production cost.

In addition to spray dryers and freeze dryers, various forms of belt dryers have been used. Such prior art drying apparatus generally include an elongated, substantially flat, horizontal belt onto which a thin layer of product is spread. The product is usually either in the form of a concentrated liquid or a semi-liquid paste. As the belt slowly revolves, heat is applied to the product from a heat source. The heat is absorbed by the product to cause moisture to evaporate there from. The dried product is then removed from the belt and collected for further processing, or for packaging, or the like.

A typical prior art apparatus and method is disclosed in U.S. Pat. No. 4,631,837 to Magoon. Referring to FIGS. 1 and 2 of the '837 patent which are reproduced in the drawings which accompany the instant application as Prior Art FIGS. 1 and 2, an elongated frame or structure is provided on which an elongated water-tight trough 10 is supported. The trough 10 is preferably made of ceramic tile. An insulation layer 12 is provided on the outer surface of the trough 10. The interior surface of the trough 10 is lined with a thin polyethylene sheet 16. Parallel rollers 24, 26 are provided, with one roller being located at each end of the trough 10. One of the rollers 26 is driven by a motor.

A water heater 15 and circulation system, including a pump and related piping, is also provided with the prior art apparatus of the '837 patent. The water heater 15 is configured to heat a supply of water 14 to just below its boiling point, or slightly less than 100 degrees C. The pump and related piping system is configured to circulate the water 14 through the trough 10 so that a minimum given water depth is maintained throughout the trough. In addition, the water heater 15 and related circulation system is configured to maintain the water supply within the trough at a temperature which is slightly less than 100 degrees C.

A flexible sheet of polyester, infra-red transparent material 18 in the form of an endless belt is supported about the rollers 24, 26 at each end, and is also supported on top of the water supply 14 within the trough 10. That is, the polyester belt 18 is driven by the roller 26 and revolves there about and the roller 24, while floating on the water 14 within the trough 10. A thin layer of liquid product 20 is dispensed onto the revolving belt 18 by way of a product discharge means 28 which is located at an intake end of the apparatus.

As the layer of product 20 travels along the trough 10 on the belt 18 which floats on the water 14, the product is heated by the water 14 which is maintained near 100 degrees C., and on which the belt 18 floats. The heat from the water 14 drives moisture from the product 20 until the product reaches the desired dryness, whereupon the product is removed from the belt 18. The rate at which the belt 18 moves through the trough 10 can be regulated so that the product 20 will reach its desired dryness at the discharge end of the apparatus where it is removed there from.

Several characteristics of the drying apparatus and method disclosed by the '837 patent lead to inconvenient and troublesome use of the apparatus. For example, the trough 10 of a typical prior art apparatus as disclosed by the '837 patent has a length within the range of 12 to 24 meters or more. As a result, the apparatus occupies a relatively large amount of production space. Also, several potential problems regarding the operation of the prior art apparatus can be attributed to the use of water as a heat source.

For example, the prior art apparatus requires a relatively massive water heating and circulation system 15 for its operation. The water heating and circulation system 15 can prove troublesome in several ways. First, the water heating and circulation system 15 adds complexity to the configuration and construction of the apparatus as well as to its operation. The system 15 incorporates a water heater, a pump, and various pipes and valves which must all be maintained in a relatively leak-proof manner. The required water heating and circulation system 15 can also deter the ease of mobility of the prior art dryer because of the bulky nature of the system and because of the need for a water supply.

Secondly, the water 14, which is maintained below the boiling point can serve as a harbor for potentially dangerous microbial organisms which can cause contamination of the product 20. Thirdly, the presence of a large amount of water 14 can serve to counter the objective of the prior art apparatus which is to remove moisture from the product 20. That is, the water 14, by way of inevitable leaks and evaporation from the trough 10, can enter the product 20 thereby increasing the drying time of the product.

Moreover, because the water 14 is the sole source of heat for drying of the product 20, and because the water temperature is maintained below 100 degrees C., the process of drying of the product 20 is relatively slow. As a universally accepted rule, the quantity of heat transferred between two bodies is proportional to the difference in the temperature of each of the bodies. Also, as a general rule, the moisture contained in the product to be dried must absorb a relatively great amount of energy in order to vaporize. The product 20 initially contains a relatively high amount of moisture when it is initially spread onto the support surface 18. Thus, a relatively high amount of heat energy is required to vaporize the moisture and remove it from the product 18.

However, because the temperature of the water heat source of the prior art apparatus never exceeds 100 degrees C., the difference in the temperatures of the heat source and the product 20 is limited which, in turn limits the transfer of heat to the product. As the product 20 absorbs heat from the heat source, the temperature of the product will rise. This rise in temperature of the product as it travels through the apparatus results in an even lower difference in temperature between the product 20 and heat source which, in turn, further reduces the amount of heat transfer from the heat source to the product. For this reason, the prior art apparatus often requires extended processing times in order to satisfactorily remove moisture from the product 20.

Also, the prior art apparatus and method of the '837 patent does not provide for any flexibility in processing temperatures because the temperature of the heat source cannot be easily changed, if at all. For example, the production of some products can benefit from specific temperature profiles during the drying process. The "temperature profile" of a product refers to the temperature of the product as a function of the elapsed time of the drying process. However, because the temperature of the heat source of the prior art apparatus is not only limited to 100 degrees Centigrade, but also slow to change, the temperature profile of the product cannot be easily controlled, or changed.

Because the prior art apparatus disclosed by the '837 patent employs water as a heat source, and requires a large water heating system for its operation, the resulting prior art apparatus is large, heavy, immobile, complex, difficult to maintain, and can be a source of microbial contamination of the product. Additionally, because the temperature of the water heat source utilized by the prior art method and apparatus is limited to less than 100 degrees Centigrade, the prior art method of drying can be slow and inefficient, and does not provide for modification or close control of the product temperature profile.

Drying systems incorporating infrared heating elements can solve many of the problems of the prior art apparatus of the '837 patent. Such a drying system is disclosed in U.S. Pat. No. 6,539,645, which is incorporated herein by reference.

It is known that the wavelength band emitted from an infrared heater can be controlled by adjusting the temperature of the infrared heater. Increasing the temperature of an infrared heater will produce radiation of shorter wavelengths while decreasing the temperature of an infrared heater will produce radiation of longer wavelengths. Prior techniques for heating certain substances with infrared radiation have included selection of a particular wavelength band of infrared radiation that is most efficiently absorbed by the substance being heated and/or that produces a desired heating effect.

U.S. Pat No. 5,382,441, for example, discloses an infrared heating system for heating baked goods. The '441 patent discloses that known IR food processes control the source temperature of the heaters to adjust the wavelength of the radiation during a baking process. If greater surface heating is required, the source temperature is decreased to produce longer wavelengths that are less capable of penetrating the surface of the product. Conversely, if less surface heating is required, the source temperature is increased to produce wavelengths that are more capable of penetrating the surface of the product.

U.S. Pat. No. 5,974,688 discloses an infrared heating system for drying wastewater sludge. The system disclosed in the '688 patent purportedly maintains the source temperature of infrared heaters at a temperature that produces wavelengths in a range that maximizes the heat transfer rate into wastewater sludge, thereby minimizing drying time.

However, the prior art techniques of the '411 and '688 patents are insufficient for heating and drying applications where it is desirable to precisely control the temperature of the product being dried, for example, to heat the product according to a predetermined temperature profile that produces the best results for a particular product, such as when drying liquid food products. The need to maintain or control the temperature of the product being dried is directly at odds with the need to heat the product with radiation of a particular wavelength, such as to maximize the heat transfer rate. For example, if the product becomes too hot, then the temperature of the heater must be decreased to avoid overheating and/or burning the product, however decreasing the temperature will increase the wavelength of the radiation. Conversely, if the product requires more heat in a short amount of time to avoid underheating the product, then the temperature of the heater must be increased, which will decrease the wavelength of the radiation. As can be appreciated, the prior art techniques of the '411 and the '688 patents sacrifice the ability to control the temperature profile of the product by maintaining the heat sources at predetermined settings that produce radiant heat at the desired wavelength.

SUMMARY

According to one aspect, the present disclosure concerns a drying or heating apparatus that is capable of independently controlling the temperature of the product being heated (e.g., to achieve a desired temperature profile) and the wavelength of the radiation (e.g., to maximize the heat transfer rate). To such ends, a drying apparatus can be provided with one or more heat sources that are movable relative to the product being heated in order to increase or decrease the gap or spacing between the heat source and the product. By adjusting the gap between the product and the heat source, it is possible to control the source temperature in such a manner that produces the desired product temperature and wavelength of radiation.

For example, if a particular drying profile requires that the temperature of the product remain substantially constant through one or more control zones, then the product typically is subjected to less heat in each successive control zone. To maintain the desired product temperature and wavelength of radiation, the heaters in a control zone can be moved farther away from the product to decrease the heat applied to the product while maintaining the source temperature to produce radiation at the desired wavelength. If desired, the source temperature and heater positions can be controlled to produce a predetermined constant wavelength in successive zones and to heat the product at the desired temperature profile to compensate for changes in energy required to evaporate moisture as the moisture content in the product decreases as it is dried through each of the zones. In other words, unlike the '411 and the '688 patents, the drying apparatus of the present disclosure has the ability to heat a product or object at a predetermined wavelength, such as to maximize heat absorption by the product or object, without sacrificing control over the temperature profile of product or object being heated.

In one representative embodiment, a drying apparatus comprises a movable product conveyor having a product support surface for supporting a product to be dried, at least first and second heater supports, and a controller. Each heater support supports one or more dry radiant heating elements and is movable relative to each other and relative to the conveyor to adjust the distance between each heater support and the conveyor. The product conveyor is configured to move relative to the first and second heater supports such that the product supported on the conveyor is successively heated by the heating elements of the first heater support and the heating elements of the second heater supports. The controller is configured to adjust the temperature of the heating elements of each heater support and the distance between the heating elements of each heater support and the conveyor such that the heating elements emit radiant heat at a predetermined wavelength and heat the product according to a predetermined product temperature profile.

In another representative embodiment, a drying apparatus comprises a movable product conveyor having a product support surface for supporting a product to be dried, at least first and second heating zones, and a controller. The conveyor is operable to convey the product through the heating zones. The first heating zone comprises a first set of one or more radiant heating elements mounted underneath the product support surface for movement upwardly and downwardly relative to the product support surface. The second heating zone comprises a second set of one or more radiant heating elements mounted underneath the product support surface for movement upwardly and downwardly relative to the product support surface. The controller is configured to continuously monitor the wavelength of the heating elements in each zone and the product temperature in each zone and to adjust the temperature of the heating elements in each zone and the distance between the heating elements of each zone and the conveyor such that the heating elements emit radiant heat at a predetermined wavelength in each zone and heat the product according to a predetermined product temperature profile.

In another representative embodiment, a method of drying a product comprises applying a product to be dried onto a product support surface of a movable conveyor; conveying the product on the conveyor through at least a first heating zone and a second heating zone; and heating the product with a first set of one or more dry radiant heating elements in the first heating zone and heating the product with a second set of one or more dry radiant heating elements in the second heating zone. As the conveyor conveys the product through the first and second heating zones, the temperature of the heating elements and the distance between each set of heating elements and the product support surface are adjusted so as to heat the product at a predetermined temperature profile and to cause the heating elements to emit radiant heat at a predetermined wavelength.

The foregoing and other features and advantages of the invention will become more apparent from the following detailed description, which proceeds with reference to the accompanying figures.

DETAILED DESCRIPTION

The present disclosure provides for methods and apparatus for drying a product containing moisture. The apparatus generally includes a support surface which is substantially transparent to radiant heat. The product is supported on a first side of the support surface or conveyor while radiant heat is directed toward a second side of the support surface to heat the product for drying. The apparatus can also generally include a sensor which is configured to detect and measure at least one characteristic of the product, such as temperature or moisture content. The measurement of the product characteristic can be used to regulate the temperature of the heat source so as to radiate a desired quantity of heat to the product.

The drying methods and apparatus disclosed herein are particularly useful for dehydrating liquid or vegetable liquids (such as juices, purees, pulps, extracts, etc.) and other plant matter. Such substances can be dehydrated to a moisture content below 5%, typically about 3.0%, all while substantially preserving full nutrition and flavor. Due to the extremely low moisture content, the dehydrated liquids (or other dehydrated product) can be milled into powders that are free flowing and shelf stable. The powders can be used in a variety of food-related products, nutraceuticals and pharmaceuticals.

Embodiments of Drying Apparatus

Figure 1:
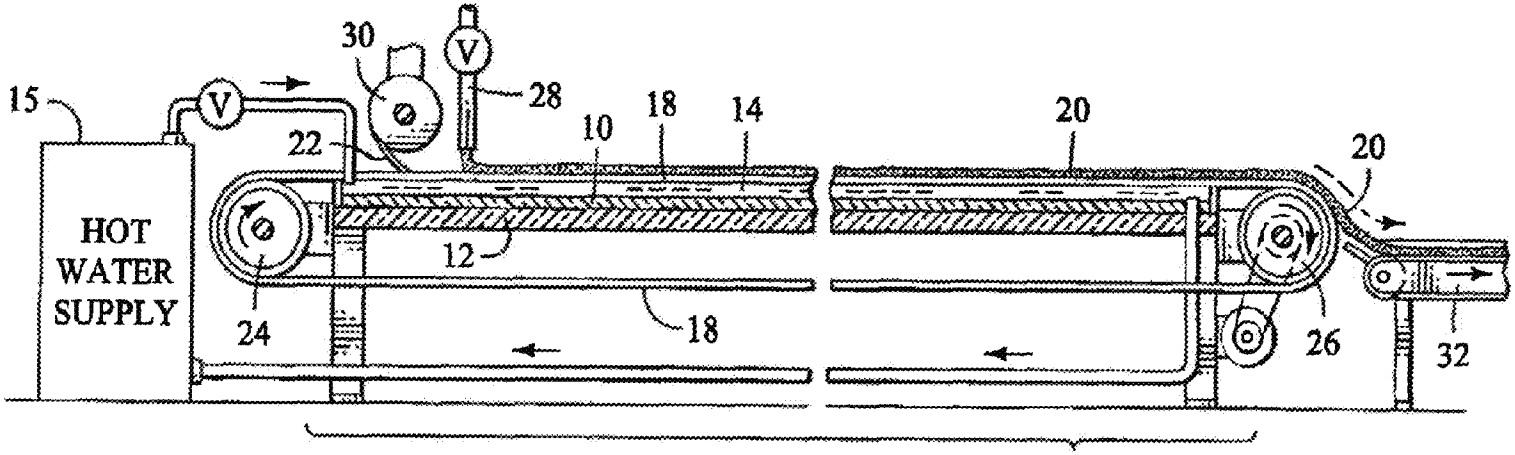
FIG.1 PRIOR ART
FIG. 1 is a side elevation diagram of a prior art apparatus.
Figure 2:
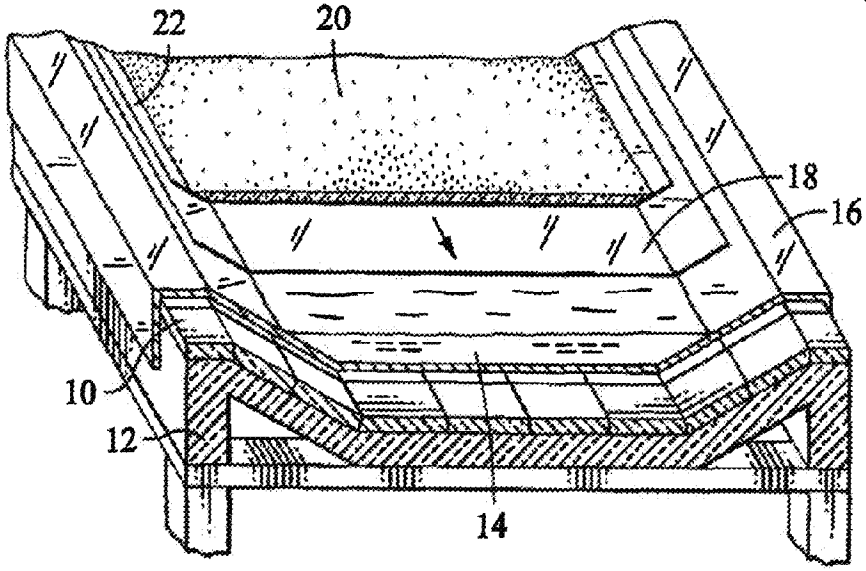
FIG.2 PRIOR ART
FIG. 2 is a partial perspective of the prior art apparatus depicted in FIG. 1.
Figure 3:
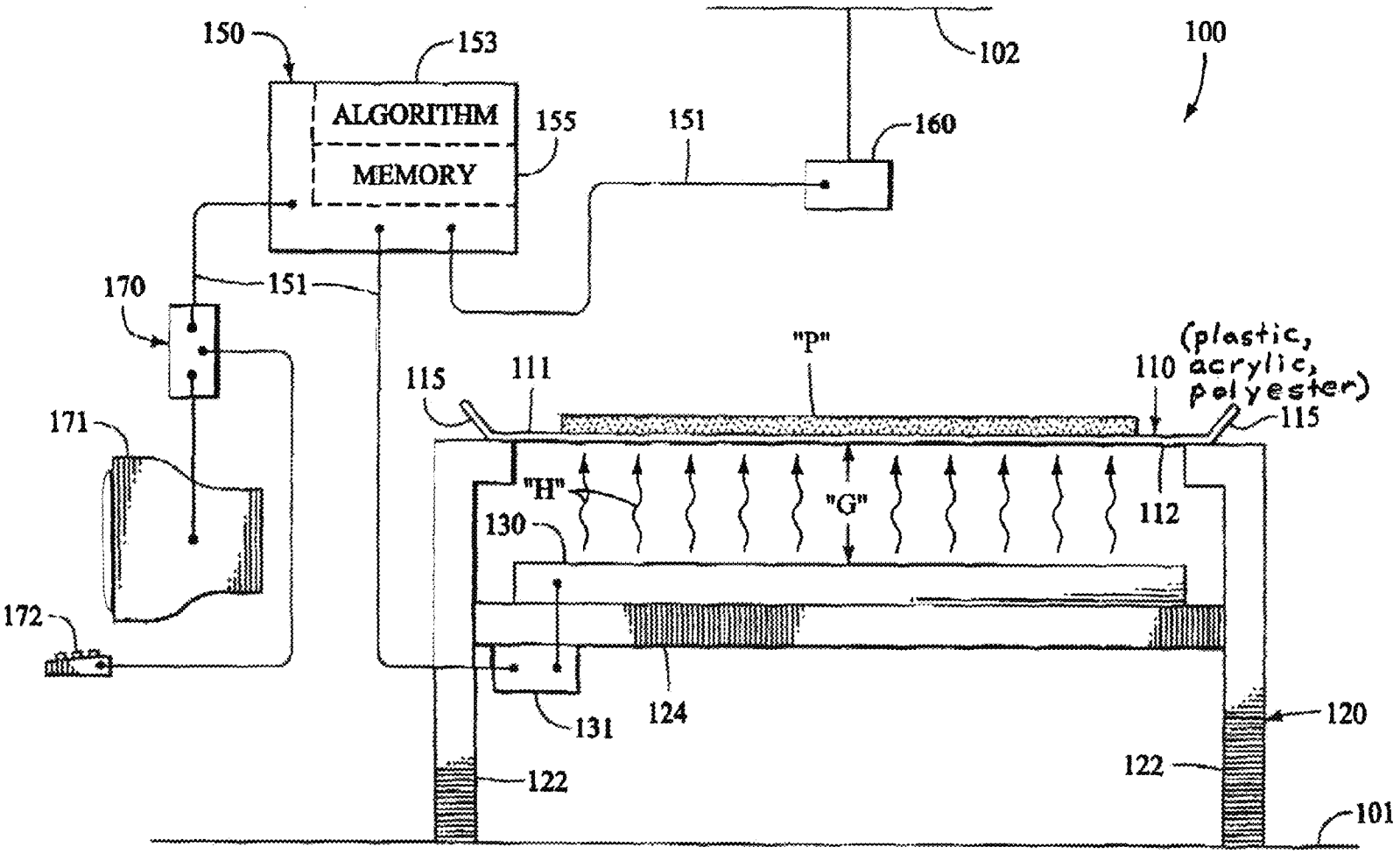
FIG. 3 is a side elevation diagram of an apparatus in accordance with a first embodiment of the present disclosure.

Referring to FIG. 3, a side elevation view of a basic drying apparatus 100 in accordance with a first embodiment of the present disclosure is depicted. The drying apparatus 100 is generally configured to remove a given amount of moisture from a product "P" to dry or concentrate the product. The product "P" can be in any of a number of types, including aqueous colloidal suspensions, or the like, which can be in the form of a liquid or paste, and from which moisture is to be removed there from by heating. The product "P" is generally spread, or otherwise placed, onto the apparatus 100 for drying. Once the product "P" has reached the desired dryness, it is then removed from the apparatus 100.

The apparatus comprises a support surface 110 onto which the product "P" is placed for drying. The support surface 110 has a first side 111 which is configured to support a layer of the product "P" thereon as shown. The support surface also has second side 112 which is opposite the first side 111. Preferably, the first side 111 is substantially flat and supported in a substantially horizontal manner so that, in the case of a liquid product "P," a substantially even layer thereof is formed on the first side. In addition, lips 115 can be formed on the edges of the support surface 110 for the purpose of preventing the product "P" from running off the first side 111 of the support surface.

The support surface 110 can be configured as a substantially rigid tray or the like as shown. However, in an alternative embodiment of the present invention which is not shown, the support surface 110 can be a relatively thin, flexible sheet which is supported by a suitable support system or the like. The support surface 110 is configured to allow radiant heat to pass there through from the second side 112 to the first side 111. The term "radiant heat" means heat energy which is transmitted from one body to another by the process generally known as radiation, as differentiated from the transmission of heat from one body to another by the processes generally known as conduction and convection.

The support surface 110 is fabricated from a material which is substantially transparent to radiant heat and also able to withstand temperatures of up to 300 degrees Fahrenheit. Preferably, the support surface 110 is fabricated from a material comprising plastic. The term "plastic" means any of various nonmetallic compounds synthetically produced, usually from organic compounds by polymerization, which can be molded into various forms and hardened, or formed into pliable sheets or films.

More preferably, the support surface 110 is fabricated from a material selected from the group consisting of acrylic and polyester. Such materials, when utilized in the fabrication of a support surface 110, are known to have the desired thermal radiation transmission properties for use in the present invention. Further, plastic resins can be formed into a uniform, flexible sheet, or into a seamless, endless belt, which can provide additional benefits.

Also, such materials are known to provide a smooth surface for even product distribution, a low coefficient of static friction between the support surface 110 and the product "P" supported thereon, flexibility, and resistance to relatively high temperatures. In addition, such materials are substantially transparent to radiant heat, have relatively high tensile strengths, and are relatively inexpensive and easily obtained.

The apparatus 100 can also comprise a chassis 120. The chassis is preferably rigidly constructed and can include a set of legs 122 which are configured to rest on a floor 101 or other suitable foundation, although the legs can also be configured to rest on bare ground or the like. The chassis 120 can also include a bracket 124, or the like, which is configured to support thereon a dry radiant heat source 130 which is exposed to the second side 112 of the support surface 110.

The term "exposed to" means positioned such that a path, either direct or indirect, can be established for the transmission of radiant heat energy, wave energy, or electromagnetic energy between two or more bodies. The heat source 130 is configured to direct radiant heat "H" across a gap "G" and toward the second side 112 of the support surface 110.

The term "dry radiant heat source" means a device which is configured to produce and emit radiant heat, as well as direct the radiant heat across a gap to another body, without the incorporation or utilization of any liquid heating medium or substance of any kind, including water. The term "gap" means a space which separates two bodies between which heat is transferred substantially by radiation and wherein the two bodies do not contact one another.

Since the apparatus 100 does not employ water, or other liquid, as a heating source or heating medium, the apparatus 100 is greatly simplified over prior art apparatus which do employ liquid heating media. In addition, the absence of a liquid heat medium in the apparatus 100 provides additional benefits.

For example, the absence of a water heating medium decreases likelihood of microbial contamination of the product "P" as well as the likelihood of re-wetting the product. Moreover, the absence of liquid heating medium and associated heating/pumping system enables the apparatus 100 to be moved and set up relatively easily and quickly which can provide benefits in such applications as on-site field harvest/processing.

The dry radiant heat source 130 is preferably configured to direct radiant heat "H" toward the second side 112 of the support surface 110. Preferably, the dry radiant heat source 130 is positioned relative to the support surface 110 such that the second side 112 thereof is directly exposed to the radiant heat source. However, in an alternative embodiment of the present invention which is not shown, reflectors or the like can be employed to direct the radiant heat "H" from the radiant heat source 130 to the second side 112 of the support surface 110. Also, although it is preferable for the heat source 130 to be positioned so as to direct heat "H" toward the second side 112, it is understood that the heat source can be positioned so as to direct heat toward the first side 111, and thus directly at the product "P" in accordance with other alternative embodiments of the present invention which are not shown.

Preferably, the radiant heat source 130 is configured to operate using either electrical power or gas. The term "gas" means any form of combustible fuel which can include organic or petroleum based products or by-products which are either in a gaseous or liquid form. More preferably, the radiant heat source 130 is selected from the group consisting of gas radiant heaters, and electric heaters. The term "gas radiant heaters" means devices which produce substantially radiant heat by combusting gas. The term "electric radiant heaters" means devices which produce substantially radiant heat by drawing electrical current. Various forms of such heaters are known in the art. The use of such heaters as the heat source 130 can be advantageous because of the several benefits associated therewith.

For example, such heaters can attain high temperatures and can produce large quantities of radiant heat energy. Such heaters can attain temperatures of at least 100 degrees Centigrade and can attain temperatures significantly greater than 100 degrees Centigrade. The high temperatures attainable by these heaters can be beneficial in producing large amounts of heat energy. In addition, the temperature of the heater, and thus the amount of radiant heat energy produced, can be relatively quickly changed and can be easily regulated by proportional modulation thereof. Also, such heaters generally tend to be relatively light in weight compared to other heat sources, and are generally resistant to shock and vibration.

Since electric radiant heaters such as quartz heaters and ceramic heaters draw electrical power for operation, such heaters can be operated either from a portable generator, or from a permanent electrical power grid. Similarly, radiant gas heaters can be operated either from a portable gas supply, such as a liquified natural gas tank, or from a gas distribution system such as an underground pipeline system. Furthermore, heaters such as those discussed above are generally known to provide long, reliable operating life and can be serviced easily.

The radiant heat source 130 is preferably configured to reach a temperature greater than 100 degrees, Centigrade, and more preferably, the heat source is configured to reach a temperature significantly greater than 100 degrees, Centigrade, such as 150 degrees, Centigrade. The radiant heat source 130 can be configured to vary the amount of radiant heat that is directed toward the support surface 110. That is, the radiant heat source 130 can be configured to modulate the amount of heat that it directs toward the support surface 110.

Preferably, the radiant heat source 130 can be configured modulate so that the temperature thereof can be increased or decreased in a rapid manner. The heat source 130 can be configured to modulate by employing an "on/off" control scheme. Preferably, however, the heat source can be configured to modulate by employing a true proportional control scheme.

To facilitate the operational control of the heat source 130, the apparatus 100 can include a control device 131 which is connected to the heat source. The control device 131 can be an electrical relay as in the case of an electrically powered heat source 130. Alternatively, the control device 131 can be a servo valve as in the case of a gas powered heat source 130.

The support surface 110 can be configured to be movable with respect to the radiant heat source 130. For example, the support surface 110 can be configured as a movable tray which can be placed onto, and removed from, the chassis 120 as shown in FIG. 3. In an alternative configuration of the first embodiment of the invention, the chassis 120 can include rollers or the like on which the support surface 110 can be supported and moved.

Figure 3A:
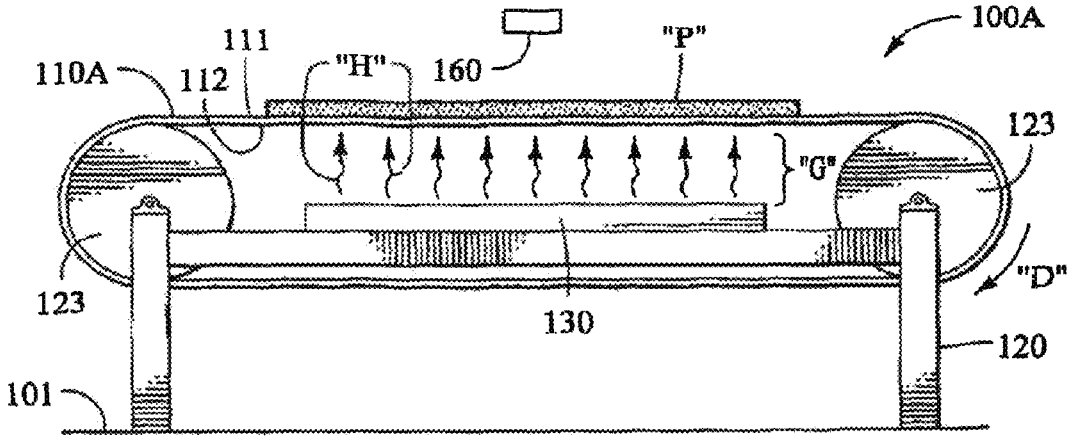
FIG. 3A is a side elevation diagram of an apparatus in accordance with a second embodiment.

For example, referring to FIG. 3A, a side elevation diagram is shown of an apparatus 100A in accordance with a second embodiment of the present invention. As is evident, the support surface 110A of the apparatus 100A is configured as an endless belt comprising a flexible sheet supported by rollers 123. The support surface 110A can be configured to move, or circulate, in the direction "D."

The rollers 123 are, in turn, supported by the chassis 120A which also supports at least one heat source 130. The heat source 130 is configured to direct radiant heat "H" toward the second side 112 of the support surface 110A. Opposite the second side 112, is the first side 111 of the support surface 110A which is configured to movably support the product "P" thereon. As is seen, the configuration of the apparatus 100A can provide for continuous processing of the product "P."

Figure 3B:
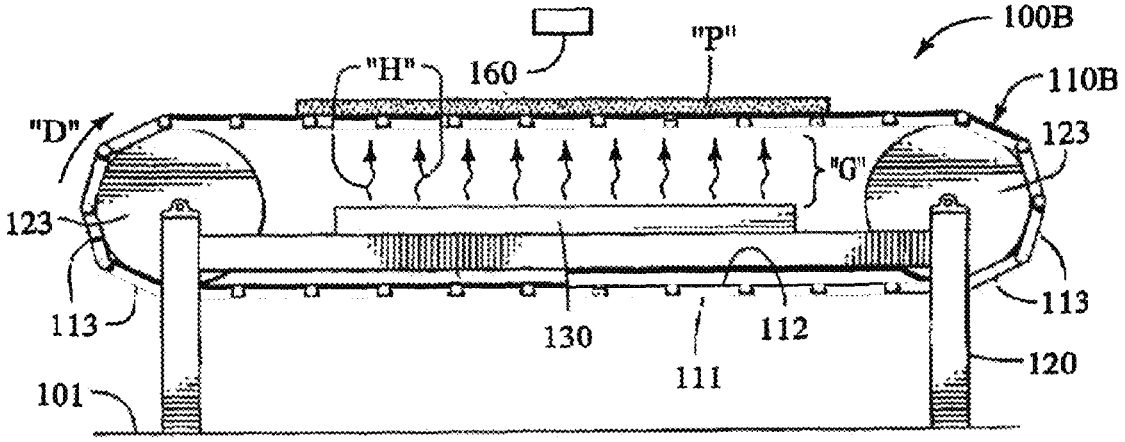
FIG. 3B is a side elevation diagram of an apparatus in accordance with a third embodiment.

Turning now to FIG. 3B, a side elevation diagram is shown which depicts an apparatus 100B in accordance with a third embodiment of the present invention which is similar to the apparatus 100A discussed above for FIG. 3A. However, the support surface 110B of the apparatus 100B is not only configured as an endless belt, but also comprises a plurality of rigid links 113 which are pivotally connected to one another in a chain-like manner.

As shown, the apparatus 100B comprises a chassis 120 which rotatably supports rollers 123 thereon. The rollers 123 in turn movably support the support surface 110B thereon, which can be configured to move, or circulate, in the direction "D." The chassis 120 also supports a heat source 130 thereon which is configured to direct radiant heat "H" toward the second side 112 of the support surface 110B. The support surface 110B is configured to support the product "P" on the first side 111 which is opposite the second side 112.

Figure 3C:
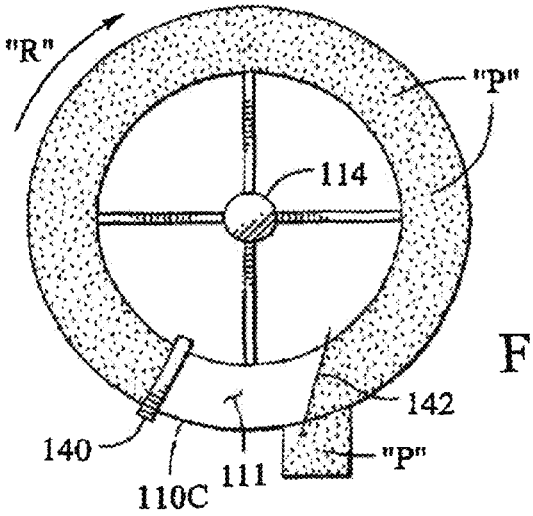
FIG. 3C is a top plan view of an apparatus in accordance with a fourth embodiment.

Moving to FIG. 3C, a top plan view is shown of an apparatus 100C in accordance with a fourth embodiment of the present invention. In accordance with the apparatus 100C, the support surface 110C is substantially configured as a flat, horizontal ring which is configured to rotate in the direction "R." The support surface 110C can be configured to rotate in the direction "R" about a center portion 114 which can comprise a bearing (not shown) or the like. The upper, or first, side 111 of the support surface 110A is configured to support the product "P" thereon.

The product "P" can be placed onto the first side 111 of the support surface 110A at an application station 140, and can be removed from the support surface at a removal station 142. At least one heat source (not shown) can be positioned beneath the support surface 110A such that radiant heat (not shown) is directed from the heat source to a lower, or second, side (not shown) which is opposite the first side 111.

Returning now to FIG. 3, the apparatus 100 can comprise a controller 150 such as a digital processor or the like for executing operational commands. The controller can be in communication with the radiant heat source 130 by way of the control device 131 as well as at least one communication link 151. The communication link 151 can include either wire communication, or wireless communication means. The term "in communication with" means capable of sending or receiving data or commands in the form of signals which are passed via the communication link 151.

The apparatus 100 can also comprise a sensor 160 which can be supported by a ceiling 102 or other suitable support, and which can be in communication with the controller 150 by way of a communication link 151. The sensor 160 is configured to detect and measure at least one characteristic of at least a portion of the product "P." The characteristic can include, for example, the temperature of the product "P," the moisture content of the product, or the chemical composition of the product. The sensor 160 can be any of a number of sensor types which are known in the art. Preferably, the sensor 160 is either an infrared detector, or a bimetallic sensor.

The apparatus 100 can further include an operator interface 170 which is in communication with the controller 150 and which is configured to allow an operator to input commands or data into the controller 150 by way of a keypad or the like 172 which can be included in the operator interface. The operator interface 170 can also be configured to communicate information regarding the operation of the apparatus 100 to the operator by way of a display screen or the like 171 which can also be included in the operator interface. The controller can include an algorithm 153 which can be configured to automatically carry out various steps in the operation of the apparatus 100. The controller 150 can further include a readable memory 155 such as a digital memory or the like for storing data.

During operation of the apparatus 100, the product "P" can be placed upon the first side 111 of the support surface 110. Various means of placing the product "P" upon the first side 111 can be employed, including spraying, dripping, pouring, and the like. The operator of the apparatus 100 can input various data and commands to the controller 150 by way of the operator interface 170. These data and commands input by the operator can include the type of product "P" to be processed, the temperature profile to be maintained in the product, as well as "start" and "stop" commands.

The algorithm 153 can include at least one predetermined heat curve which is associated with at least one particular product "P." The term "heat curve" means a locus of values associated with the amount of heat produced by the heat source 130 and which locus of values is a function of elapsed time. After the operator identifies the particular product "P" and inputs this into the controller 150, the drying process, in accordance with temperature parameters dictated by the predetermined heat profile, can be carried out automatically. In addition, the drying process can be adjusted "on the fly" based on inputs from the sensor 160 received by the controller during the process, as described below.

Once the drying operation begins, the sensor 160 can detect and measure at least one characteristic of at least a portion of the product "P" such as the temperature, moisture content, or chemical composition thereof. The sensor 160 can be instructed by the controller 150, or otherwise configured, to repeatedly perform the detection and measurement of a characteristic of the product "P" at given intervals during the operation of the apparatus 100. Alternatively, the sensor 160 can be configured to continuously detect and measure the characteristic during the operation of the apparatus 100.

The measured characteristic which is detected and measured by the sensor 160 can be converted into a signal, such as a digital signal, and can then transmitted to the controller 150 by way of one of the communication links 151. The controller 150 can then receive the signal sent by the sensor 160, and can then store the signal as readable data in the readable memory 155. The controller 150 can then cause the algorithm 153 to be activated, wherein the algorithm can access the data in the readable memory 155 and then use the data to initiate an automatic operational command.

For example, the controller 150 can use the signal data sent by the sensor 160 to control the radiant heat source 130. That is, the controller 150 can use the signal data from the sensor 160 to control the amount of radiant energy "H" directed toward the support surface 110. This can be accomplished in various manners such as by turning the heat source on or off for specific time intervals, or by proportionally modulating the heat output produced by the energy source 130.

In a typical drying operation, for example, a product "P" can be placed onto the first side 111 of the support surface 110 as shown so as to be supported thereon. The operator can, by way of the interface 170, communicate to the controller 150 the type of product "P" which is to be dried. Alternatively, the operator can enter other data such as the estimated moisture content, or the like, of the product "P." The operator can also cause the apparatus 100 to commence a drying operation by entering a "start" command into the interface 170.

When the drying operation commences, the sensor 160 can detect and measure a characteristic of the product "P" such as the temperature, moisture content, or chemical composition thereof. The sensor 160 can then convert the measurement of the characteristic to a signal and then send the signal to the controller 150. For example, if the measured characteristic is the temperature of the product, then the sensor can send to the controller 150 a signal which contains data regarding the temperature of the product.

The controller 150 can use the data sent by the sensor 160 to regulate various functions of the apparatus 100. That is, the controller 150 can regulate the amount of radiant heat "H" produced by the radiant heat source 130 and directed to the product "P" as a function of the characteristic detected and measured by the sensor 160.

The controller 150 can also regulate the amount of radiant heat "H" produced by the radiant heater 130 as a function of elapsed time, as well as the particular type of product "P" which is to be dried. In alternative embodiments such as those described above for FIGS. 3A, 3B, and 3C, wherein the support surface 110 is configured to move the product "P" past the heat source 130, the controller 150 can regulate the speed at which the support surface 110, and thus the product, moves past the heat source.

The particular type of product "P" to be dried can have an optimum profile associated therewith, which, when adhered to, can optimize a given production result such as minimum drying time, or maximum quality of the product "P." The term "profile" means a locus of values of one or more measured product characteristics as a function of elapsed time. For example, a given product "P" can have associated therewith a given optimum temperature profile, an optimum moisture content profile, or an optimum chemical composition profile. The readable memory 155 can store optimum profiles for several types of products "P." Each of the stored optimum profiles can then be accessed by the algorithm 153 in accordance with instructions or commands entered into the controller 150 by the operator.

For example, the particular product "P" to be dried, for example, can have an optimum temperature profile that dictates an increase in the temperature of the product at a maximum rate possible and to a temperature of 100 degrees Centigrade. The optimum temperature profile can further dictate that, once the product "P" attains a temperature of 100 degrees Centigrade, the product temperature is to be maintained at 100 degrees Centigrade for an elapsed time of five minutes, after which the temperature of the product "P" is to decrease at a substantially constant rate to ambient temperature over an elapsed time of ten minutes.

The algorithm 153 can attempt to maintain the actual temperature of the product "P" so as to substantially match the optimum temperature profile stored in the a given temperature profile of the product "P" by regulating the amount of heat energy "H" produced by the heat source 130. For example, in order to cause the temperature of the product "P" to increase rapidly so as to substantially match the optimum temperature profile, the algorithm 153 can cause the radiant heat source 130 to initially produce maximum output of radiant heat "H." This can be accomplished by causing the temperature of the heat source to increase rapidly to a relatively high level.

The heat energy "H" is directed from the heat source 130 to the second side 112 of the support surface 110. Because the support surface 110 in configured to allow the radiant heat "H" to pass there through, the product "P" will absorb at least a portion of the radiant heat. The absorption of the heat energy "H" by the product "P" results in an increased temperature of the product which, in turn, promotes moisture evaporation from the product. When the sensor 160 detects that the product "P" has reached a given temperature, such as 100 degrees Centigrade, the algorithm 153 can then begin a first elapsed time countdown having a given duration, such as five minutes.

During the first countdown, the algorithm 153, in conjunction with temperature measurements received from the sensor 160, can regulate the amount of heat output "H" produced by the radiant heat source 130 in order to maintain the temperature of the product "P" at a given temperature, such as 100 degrees Centigrade. For example, as moisture evaporates from the product "P," the product can require less heat energy "H" to maintain a given temperature. At the end of the first countdown, the algorithm 153 can then begin a second elapsed time countdown having a given duration, such as ten minutes.

During the second countdown, the algorithm 153 can control the heat output "H" of the radiant heat source 130 in accordance with the temperature measurements received from the sensor 160 in order to maintain an even decrease in the product temperature from, for example, 100 degrees Centigrade to ambient temperature, whereupon the drying operation is complete. Once the product "P," attains ambient temperature, or another given temperature, controller 150 can send a signal to the operator interface 170 which, in turn, can generate an audible or visual signal detectable by the operator. This audible or visual signal can alert the operator that the drying operation is complete. The operator can then remove the finished, dried product "P" from the apparatus 100.

Figure 3D:
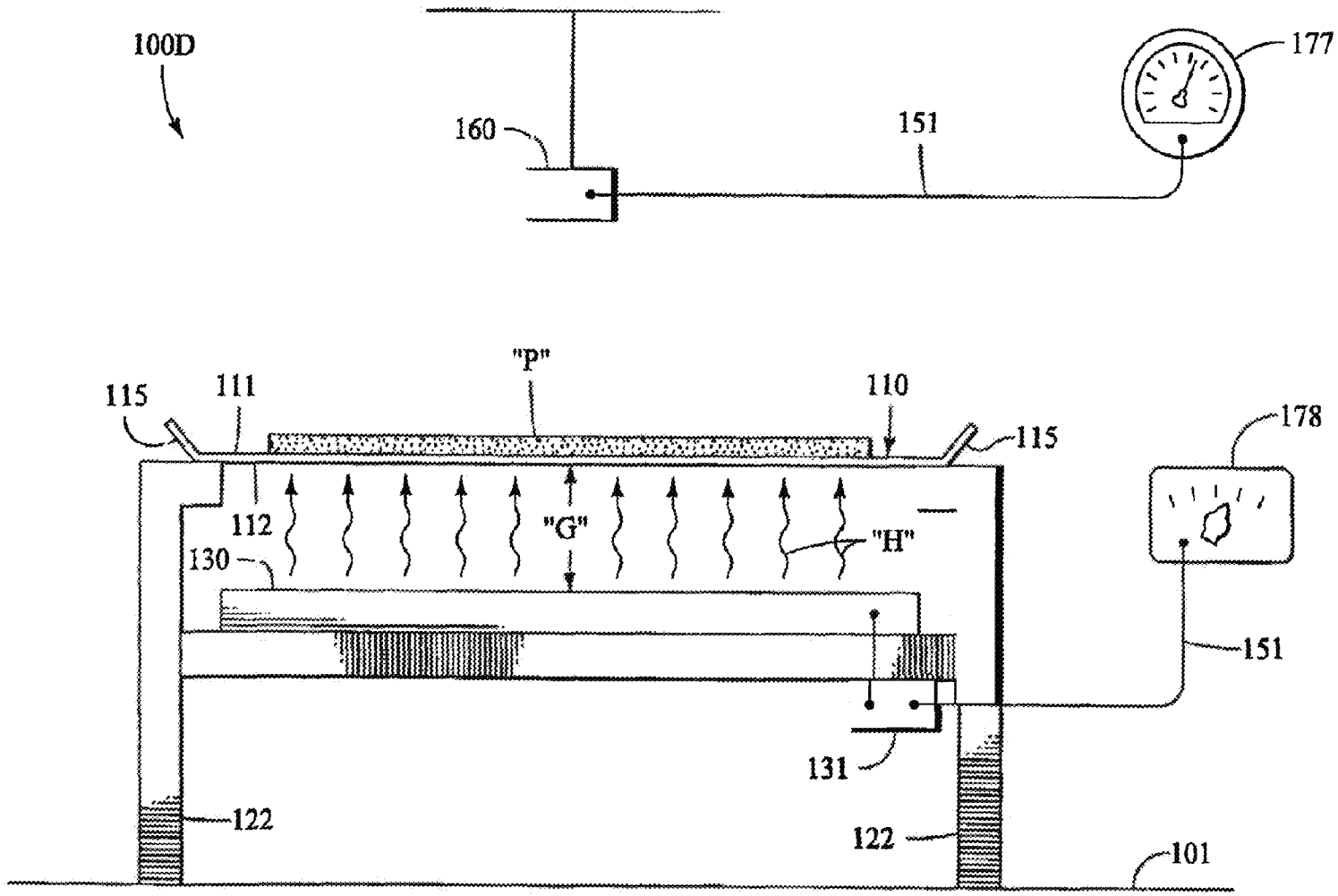
FIG. 3D is a side elevation diagram of a fifth embodiment showing an alternative operational control scheme for the apparatus depicted in FIG. 3

Moving now to FIG. 3D, a side elevation diagram is shown of an apparatus 100D which is an alternate configuration in accordance with a fifth embodiment. The apparatus 100D depicts an alternative control scheme which can be used in place of that depicted in FIG. 3 for the apparatus 100. In accordance with the alternative control scheme which is depicted in FIG. 3D, the apparatus 100D can comprise a display 177 and a manual heat source control 178. The display 177 is connected to the sensor 160 by way of a communication link 151. The display is configured to display data relating to at least on characteristic of the product "P" which is detected and measured by the sensor 160.

The manual heat source control 178 is connected to the relay 131 by way of another lo communication link 151. The manual heat source control 178 is configured to receive operator input commands relating to the amount of heat "H" produced by the heat source 130. That is, the manual heat source control 178 can be set by the operator to cause the heat source 130 to produce a given amount of heat "H."

In operation, the operator can initially set the manual heat source control 178 to cause the heat source 130 to produce a given amount of heat "H." The manual heat source control 178 then sends a signal to the relay 131 by way of a communication link 151. The relay 131 then receives the signal and causes the heat source 130 to produce the given amount of heat "H." The operator then monitors the display 177.

The sensor 160 can continually detect and measure a given characteristic of the product "P." The sensor can send a signal to the display 177 which relates to the measured characteristic. The display receives the signal and converts the signal to a value which it displays and which is readable by the operator. The operator can then adjust the heat "H" produced by the heat source 130 in response to the information relating to the measured characteristic which is read from the display 177.

As is seen, the apparatus 100, as well as the various other configurations thereof and related embodiments, can allow for much greater control of the amount of heat that is transferred to the product than can the various apparatus of the prior art. Because of this, the apparatus 100 of the present invention can produce products "P" having higher quality, and can produce the products in a more efficient manner, than the drying apparatus of the prior art.

As is further seen, the apparatus 100 can be suited for "batch" type of drying processes in which case the support surface 110 is not necessarily moved during the drying operation. In alternative embodiments such as those depicted in FIGS. 3A, 3B, and 3C, the support surface 110 can be configured to move the product "P" past the radiant heat source 130 and sensor 160, in which case a continuous drying process can be attained. In yet another embodiment of the present invention, which is described below, an apparatus 200 can be particularly suitable for producing a high-quality product in a high-output, continuous drying process.

Drying Apparatus with Multiple Control Zones

Figure 4:
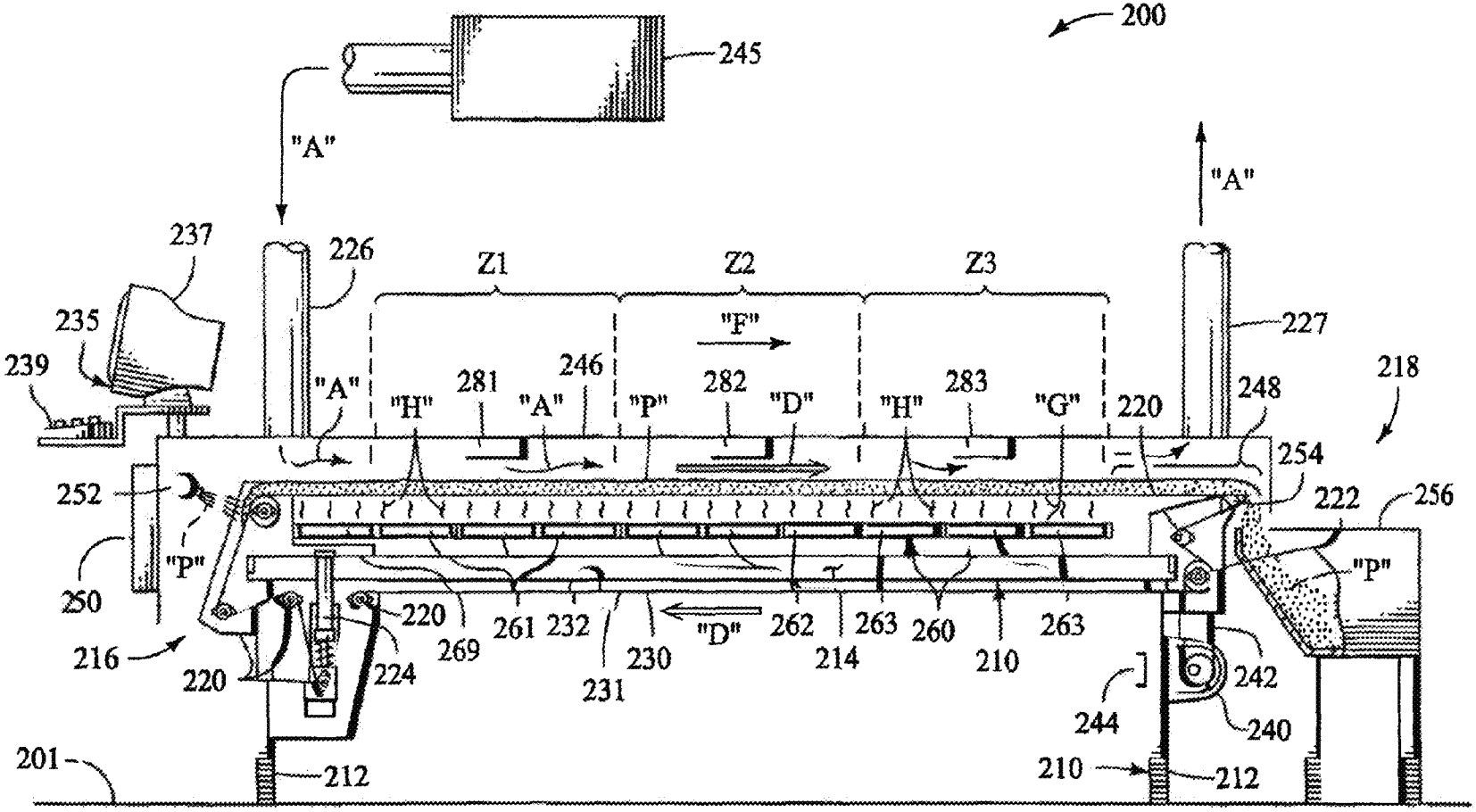
FIG. 4 is a side elevation diagram of an apparatus in accordance with a sixth embodiment.

Referring to FIG. 4, a side elevation view of a drying apparatus 200 in accordance with a sixth embodiment is depicted. The apparatus 200 comprises a chassis 210 which can be a rigid structure comprising various structural members including legs 212 and longitudinal frame rails 214 connected thereto. The legs 212 are configured to support the apparatus 200 on a floor 201 or other suitable base.

The chassis 210 can also comprise various other structural members, such as cross-braces (not shown) and the like. The chassis 210 can be generally constructed in accordance with known construction methods, including welding, fastening, forming and the like, and can be constructed from known materials such as aluminum, steel and the like. The apparatus 200 is generally elongated and has a first, intake end 216, and an opposite, distal, second, out feed end 218.

The apparatus 200 can further comprise a plurality of substantially parallel, transverse idler rollers 220 which are mounted on the chassis 210 and configured to rotate freely with respect thereto. At least one drive roller 222 can also be included in the apparatus 200 and can be supported on the chassis 210 in a substantially transverse manner as shown.

An actuator 240, such as an electric motor, can be included in the apparatus 200 as well, and can be supported on the chassis 210 proximate the drive roller 222. A drive linkage 240 can be employed to transfer power from the actuator 240 to the drive roller 222. A speed controller 244, such as an alternating current ("A/C") variable speed control device or the like, can be included to control the output speed of the actuator 240.

The apparatus 200 comprises a support surface 230, which has a first side 231 and an opposite second side 232. The support surface 230 is movably supported on the chassis 210. The support surface 230 is configured to allow radiant heat energy to pass there through from the second side 212 to the first side 211.

Preferably, the support surface 230 is fabricated from a material comprising plastic. More preferably, the support surface 230 is fabricated from a material selected from the group consisting of acrylic and polyester. Also, preferably, the support surface 230 is configured to withstand temperatures of up to at least 300 degrees Fahrenheit. The support surface 230 is configured as an endless flexible belt as shown, at least a portion of which can preferably be substantially flat and level.

As an endless belt form, the support surface 230 is preferably supported on the idler rollers 220 and drive roller 222. The support surface 230 can be configured to be driven by the drive roller 222 so as to move, or circulate, in the direction "D" relative to the chassis 210. As is seen, the support surface 230 can be configured so as to extend substantially from the intake end 216 to the out feed end 218. A take up device 224 can be supported on the chassis 210 and employed to maintain a given tension on the support surface 230.

The first side 231 of the support surface 230 is configured to support a layer of product "P" thereon as shown. The first side 231 is further configured to move the product "P" substantially from the intake end 216 to the out feed end 218. The product "P" can be in one of many possible forms, including liquid colloidal suspensions, solutions, syrups, and pastes. Is the case of a liquid product "P" having a relatively low viscosity, an alternative embodiment of the apparatus which is not shown can include a longitudinal, substantially upwardly-extending lip (similar to the lip 115 shown in FIG. 3) which can be formed on each edge of the support surface 230 to prevent the product from running off.

The product "P" can be applied to the first side 231 of the support surface 230 by an application device 252 which can be included in the apparatus 200 and which can be located proximate the intake end 216 of the apparatus 200. In the case of a liquid product "P," the product can be applied to the support surface 230 by spraying, as shown. Although FIG. 4 depicts a spraying method of applying the product "P" to the support surface 230, it is understood that other methods are equally practicable, such as dripping, brushing, and the like.

A removal device 254 can also be included in the apparatus 200. The removal device 254 is located proximate the out feed end 218, and is configured to remove the product "P" from the support surface 230. The product "P" can be in a dry or semi-dry state when removed from the support surface 230 by the removal device 254.

The removal device 254 can comprise a sharp bend in the support surface 230 as shown. That is, as depicted, the removal device 254 can be configured to cause the support surface 230 to turn sharply around a corner having a radius which is not more than about twenty times the thickness of the support surface 230. Also, preferably, the support surface 230 forms a turn at the removal device 254 which turn is greater than 90 degrees. More preferably, the turn is about between 90 degrees and 175 degrees.

The type of removal device 254 which is depicted can be particularly effective in removing certain types of product "P" which are substantially dry and which exhibit substantially self-adherence properties. It is understood, however, that other configurations of removal devices 254, which are not shown, can be equally effective in removing various forms of product "P" from the support surface, including scraper blades, low frequency vibrators, and the like. As the product "P" is removed from the support surface 230 at the out feed end 218, a collection hopper 256 can be employed to collect the dried product. Depending on the application, the dried product can be subjected to further processing, such as milling, grinding or otherwise processing the dried product into a powder.

The apparatus 200 comprises a heater bank 260 which is supported on the chassis 210. The heater bank 260 comprises one or more first heat sources 261 and one or more second heat sources 262. The heater bank 260 can also comprise one or more third heat sources 263 and at least one pre-heater heat source 269. The heat sources 261, 262, 263, 269 are supported on the chassis 210 and are configured to direct radiant heat "H" across a gap "G" and toward the second side 232 of the support surface 230.

Each of the heat sources 261, 262, 263, 269 are dry radiant heat sources as defined above for FIG. 3. The heat sources 261, 262, 263, 269 are preferably selected from the group consisting of gas radiant heaters and electric radiant heaters. Furthermore, each of the heat sources 261, 262, 263, 269 is preferably configured to modulate, or incrementally vary, the amount of radiant heat produced thereby in a proportional manner. The operation of the heat sources 261, 262, 263, 269 is more fully described below.

The apparatus 200 can comprise an enclosure 246, such as a hood or the like, which is employed to cover the apparatus. The enclosure 246 can be configured to contain conditioned air "A" which can be introduced into the enclosure through an inlet duct 226. Before entering the enclosure, the conditioned air "A" can be processed in air conditioning unit (not shown) so as to have a temperature and humidity which is beneficial to drying of the product "P." The conditioned air "A" can circulate through the enclosure 246 before exiting the enclosure by way of an outlet duct 228. Upon exiting the enclosure 246, the conditioned air "A" can be returned to the air conditioning unit, or can be vented to exhaust.

The apparatus 200 can further comprise a first sensor 281, a second sensor 282, and a third sensor 283. It is understood that, although three sensors 281, 282, 283 are depicted, any number of sensors can be included in the apparatus 200. Each of the sensors 281, 282, 283 can be supported on the enclosure 246, or other suitable structure, in a substantially evenly spaced manner as shown. Each of the sensors 281, 282, 283 can be any of a number of sensor types which are known in the art. Preferably, in the case of detecting temperature of the product "P," each of the sensors 281, 282, 283 is either an infrared detector or a bimetallic sensor.

Preferably, the sensors 281, 282, 283 are positioned so as to be substantially exposed to the first side 231 of the support surface 230. The sensors 281, 282, 283 are configured to detect and measure at least one characteristic of the product "P" while the product is movably supported on the first side 231 of the support surface 230. Characteristics of the product "P" which are detectable and measurable by the sensors 281, 282, 283 can include the temperature, moisture content, and chemical composition of the product. Operational aspects of the sensors 281, 282, 283 are more fully described below.

The apparatus 200 can comprise a controller 250 for controlling various functions of the apparatus during operation thereof. The controller 250 can include any of a number of devices such as a processor (not shown), a readable memory (not shown), and an algorithm (not shown). The controller 250 will be discussed in further detail below. In addition to the controller 250, the apparatus 200 can include an operator interface 235 which can be in communication with the controller.

The operator interface 235 can be configured to relay information regarding the operation of the apparatus 200 to the operator by way of a display screen 237 such as a CRT or the like. Conversely, the operator interface 235 can also be configured to relay data or operational commands from the operator to the controller 250. This can be accomplished by way of a keypad 239 or the like which can also be in communication with the controller 250.

As is seen, a plurality of control zones Z1, Z2, Z3 are defined on the apparatus 200. That is, the apparatus 200 includes at least a first control zone Z1, which is defined on the apparatus between the intake end 216 and the out feed end 218. A second control zone Z2 is defined on the apparatus 200 between the first control zone Z1 and the out feed end 218. The apparatus 200 can include additional control zones as well, such as a third control zone Z3 which is defined on the apparatus between the second control zone Z2 and the out feed end. Each control zone Z1, Z2, Z3 is defined to be stationary relative to the chassis 210.

A study of FIG. 4 will reveal that each first heat source 261, as well as the first sensor 281 are located within the first control zone Z1. Likewise, each second heat source 262, and the second sensor 282, are located within the second control zone Z2. Each third heat source 263, and the third sensor 283, are located within the third control zone Z3. It is further evident that the support surface 230 moves the product "P" through each of the control zones Z1, Z2, Z3. That is, as the actuator 240 moves the support surface 230 in the direction "D," a given portion of the product "P" which is supported on the support surface, is moved successively through the first control zone Z1 and then through the second control zone Z2.

After being moved through the second control zone Z2, the given portion of the product "P" can then be moved through the third control zone Z3 and on to the removal device 254. As is seen, at least a portion of the heater bank 260, such as the pre-heater heat source 269, can lie outside any of the control zones Z1, Z2, Z3. Furthermore, a cooling zone 248 can be defined relative to the chassis 210 and proximate the out feed end 218 of the apparatus 200. The cooling zone 248 can be configured to employ any of a number of known means of cooling the product "P" as the product passes through the cooling zone.

For example, the cooling zone 248 can be configured to employ a refrigerated heat sink (not shown) such as a cold black body, or the like, which is exposed to the second side 232 of the support surface 230 and which positioned within the cooling zone. Such a heat sink can be configured to cool the product "P" by radiant heat transfer from the product and through the support surface 230 to the heat sink. One type of heat sink which can be so employed can be configured to comprise an evaporator coil which is a portion of a refrigeration system utilizing a fluid refrigerant such as Freon or the like.

It is understood that the cooling zone 248 can have a relative length which is different than depicted. It is further understood that other means of cooling can be employed. For example, the cooling zone 248 can be configured to incorporate a convection cooling system (not shown) in which cooled air is directed at the second side 232 of the support surface 230. Furthermore, the cooling zone 248 can be configured to incorporate a conductive cooling system (not shown) in which refrigerated rollers or the like contact the second side 232 of the support surface 230. The operation of the apparatus 200 can be similar to that of the apparatus 100 in accordance with the first embodiment of the present invention which is described above for FIG. 3, except that the product "P" is moved continuously past the heat sources 261, 262, 263, 269 and sensors 281, 282, 283. As depicted in FIG. 4, the product "P" can be applied to the first side 231 of the moving support surface 230 proximate the intake end 216.

The support surface 230 is driven by the actuator 240 by way of the drive link 242 and drive roller 222 so as to revolve in the direction "D" about the idler rollers 220. The product "P" can be in a substantially liquid state when applied to the support surface 230 by the application device 252. The product "P," which is to be dried by the apparatus 200, is fed there through in the feed direction "F" toward the out feed end 218.

The product "P," while supported on the support surface 230 and moved through the apparatus 200 in the direction "F," passes the heater bank 260 which can be positioned in substantially juxtaposed relation to the second side 232 of the support surface so as to be exposed thereto as shown. The heater bank 260 comprises one or more first heat sources 261 and one or more second heat sources 262 which are configured to direct radiant heat "H" toward the second side 232 and through the support surface 230 to heat the product "P" which is moved in the direction "F."

The heater bank 260 can also comprise one or more third heat sources 263 and one or more pre-heater heat sources 269 which are also configured to direct radiant heat "H" toward the second side 232 to heat the product "P." The product "P," while moving on the support surface 230 in the feed direction "F," is dried by the radiant heat "H" to a desired moisture content, and then removed from the support surface at the out feed end 218 by the removal device 254.

The product "P," once removed from the support surface 230, can be collected in a collection hopper 256 or the like for storage, packaging, or further processing. The support surface 230, once the product "P" is removed there from, returns to the intake end 216 whereupon additional product can be applied by the application device 252.

In order to promote efficient product drying as well as high product quality, conditioned air "A" can be provided by an air conditioning unit (HVAC) 245, and can be circulated about the product "P" by way of the enclosure 246, intake duct 226, and outlet duct 228 as the product is moved through the apparatus 200 in the feed direction "F" concurrent with the direction of the movement of the product.

As a further enhancement to production rate and product quality, a plurality of control zones can be employed. The term "control zone" means a stationary region defined on the apparatus 200 through which the product "P" is moved and in which region radiant heat is substantially exclusively directed at the product by one or more dedicated heat sources which are regulated independently of heat sources outside of the region. That is, a given control zone includes a dedicated servomechanism for controlling the amount of heat directed at the product "P" which is within the given control zone, wherein the amount of heat is a function of a measured characteristic of the product.

As is seen, the support surface 230 is configured to move the product "P" in succession through a first control zone Z1, and then through a second control zone Z2. This can be followed by a third control zone Z3. Within the first control zone Z1, one or more first heat sources 261 direct radiant heat "H" across the gap "G" toward the product "P" as the product moves through the first control zone. Likewise, within the second control zone Z2 and within the third control zone Z3, one or more second heat sources 262 and one or more third heat sources 263, respectively, direct radiant heat "H" across the gap "G" toward the product "P" as the product moves through the second and third control zones, respectively.

The temperature of, and thus the amount of heat "H" produced by, the first radiant heat sources 261 is regulated independently of the temperature of, and amount of heat produced by, the second heat sources 262. Similarly, the third heat sources 263 are regulated independently of the first and second heat sources 261, 262. The use of the control zones Z1, Z2, Z3 can provide for greater control of production parameters as compared to prior art devices.

That is, specific product profiles and heat curves can be attained with the use of the apparatus 200 because the product "P" can be exposed to different amounts of heat "H" in each control zone Z1, Z2, Z3. Specifically, for example, the first heat sources 261 can be configured to produce heat "H" at a first temperature. The second heat sources 262 can be configured to produce heat "H" at a second temperature which is different from the first temperature. Likewise, the third heat sources 263 can be configured to produce heat "H" at a third temperature.

Thus, as the product "P" proceeds through the apparatus in the feed direction "F," the product can be exposed to a different amount of heat "H" in each of the control zones Z1, Z2, Z3. This can be particularly useful, for example, in decreasing the drying time of the product "P" as compared to drying times in prior art apparatus. This can be accomplished by rapidly attaining a given temperature of the product "P" and then maintaining the given temperature as the product proceeds in succession through the control zones Z1, Z2, Z3. The use of the control zones Z1, Z2, Z3 can also be useful in providing tight control of the amount of heat "H" which is transmitted to the product "P" so as to provide greater product quality. That is, product quality can be enhanced by utilizing the control zones Z1, Z2, Z3 to minimize over-exposure and under-exposure of the product "P" to heat energy "H."

Assuming a given product "P" is relatively moist and at ambient temperature when placed onto the support surface 230 by the application device 252, a relatively large amount of heat "H" is required to raise the temperature of the product to a given temperature such as 100 degrees Centigrade. Thus, a pre-heater heat source 269 can be employed to pre-heat the product "P" before the product enters the first control zone Z1. The pre-heater heat source 269 can be configured to continually produce radiant heat "H" at a maximum temperature and to direct a maximum amount of heat "H" to the product "P."

As the product "P" enters the first control zone Z1, the first heat sources 261 within the first control zone Z1 can be configured to produce an amount of heat "H" which sufficient to attain the given desired product temperature. The first sensor 281, in conjunction with the controller 250, can be employed to regulate the temperature of the first heat sources 261 in order to transfer the desired amount of heat "H" to the product "P." The first sensor 281 is configured to detect and measure at least one given characteristic of the product "P" while the product is within the first control zone Z1. For example, the first sensor 281 can be configured to detect and measure the temperature of the product "P" while the product is within the first control zone Z1.

The first sensor 281 can detect and measure a characteristic of the product "P" while the product is in the first control zone Z1 and then relay that measured characteristic to the controller 250. The controller 250 can then use the measurement from the first sensor 281 to modulate the temperature, or heat output, of the first heat sources 261. That is, the heat "H" produced by the first heat sources 261 can be regulated as a function of a measured product characteristic of the product "P" within the first control zone Z1 as detected and measured by the first sensor 281. This measured product characteristic can include, for example, the temperature of the product.

The second sensor 282 is similarly employed to detect and measure at least one characteristic of the product "P" while the product is within the second control zone Z2. Likewise, the third sensor 283 can be employed to detect and measure at least one characteristic of the product "P" while the product is within the third control zone Z3.

The product characteristics detected and measured by the second and third sensors 282, 283 within the second and third control zones Z2, Z3, respectively, can be likewise utilized to modulate the amount of heat "H" produced by the second and the third heat sources 262, 263 to maintain a specific temperature profile of the product "P" as the product progresses through each of the control zones.

In the case wherein the product "P" is heated rapidly to a given temperature and then maintained at the given temperature, the first heat sources 261 will likely produce heat "H" at a relatively high temperature in order to rapidly increase the product temperature to the given temperature by the time the product "P" leaves the first zone Z1. Assuming that the product "P" is at the given temperature when entering the second control zone Z2, the second and third heat sources 262, 263 will produce heat "H" at a successively lower temperatures because less heat "H" is required to maintain the temperature of the product as the moisture content thereof decreases.

As mentioned above, the sensors 281, 282, 283 can be configured to detect and measure any of a number of product characteristics, such as moisture content. This can be particularly beneficial to the production of a high-quality product "P." For example, in the above case wherein the product temperature has reached the given temperature as the product "P" enters the second control zone Z2, the second and third sensors 282, 283 can detect and measure product moisture content as the product progresses through the respective second and third control zones Z2, Z3.

If the second sensor 282 detects and measures a relatively high product moisture content of the product "P" within the second control zone Z2, then the controller 250 can modulate the second heat sources 262 so as to continue to maintain the product temperature at the given temperature in order to continue drying of the product. However, if the second sensor 282 detects a relatively low product moisture content, then the controller 250 can modulate the second heat sources 262 so as to reduce the product temperature in order to prevent overdrying the product "P."

Likewise, the third sensor 283 can detect and measure product moisture content within the third control zone Z3, whereupon the controller can determine the proper amount of heat "H" to be produced by the third heat sources 263. Although three control zones Z1, Z2, Z3 are depicted, it is understood that any number of control zones can be incorporated in accordance with the present invention.

In furtherance of the description of the interaction between the controller 250, the sensors 281, 282, 283, and the heat sources 261, 262, 263 provided by the above example, a given control zone Z1, Z2, Z3 can be described as a separate, independent, and exclusive control loop which comprises each associated sensor and each associated heat source located within the given control zone, and which is, along with the controller, configured to independently regulate the amount of heat "H" produced by the associated heat sources as a function of at least one characteristic of the product "P" measured by the associated sensor.

That is, each sensor 281, 282, 283 associated with a given control zone Z1, Z2, Z3, can be considered as configured to provide control feedback to the controller 250 exclusively with regard to characteristics of a portion of the product "P" which is in the given control zone. The controller 250 can use the feedback to adjust the output of the heat sources 261, 262, 263 in accordance with a temperature profile or other such parameters defined by the operator or otherwise stored within the controller.

In addition to decreasing the drying time of the product "P" as compared to prior art drying apparatus, the plurality of control zones Z1, Z2, Z3 of the apparatus 200 can also be employed to attain specific product profiles which can be beneficial to the quality of the product as described above for the apparatus 100.

For example, it can be assumed that the quality of a given product "P" can be maximized by following a given product temperature profile during drying. The given product temperature profile can dictate that, as the product "P" passes successively through the first, second, and third control zones Z1, Z2, Z3, the temperature of the product initially increases rapidly to a maximum given temperature, whereupon the temperature of the product "P" gradually decreases until it is removed from the support surface 230.

In that case, the first sensor 281, first heat sources 261 and controller 250 can operate in a manner similar to that described above in order to rapidly increase the product "P" temperature to a first temperature which can be reached as the product "P" passes through the first control zone Z1. The first temperature can correspond to a relatively large amount of heat "H" which is transferred to the product "P" which initially contains a high percentage of moisture.

As the product "P" passes through the second control zone Z2, the second sensor 282, second heat sources 262 and controller 250 can operate to decrease the product temperature to a relatively medium second temperature which is lower than the first temperature. The second temperature can correspond to a lesser amount of heat "H" which is required as the moisture content of the product "P" drops.

Likewise, as the product "P" passes through the third control zone Z3, the third sensor 283, third heat sources 263 and controller 250 can operate to decrease the product temperature further to a relatively low third temperature which is lower than the second temperature. The third temperature can correspond to a relatively low amount of heat "H" which is required as the product "P" approaches the desired dryness.

In addition to regulating the temperature of the heat sources 261,262,263, the controller 250 can also be configured to regulate the speed of the support surface 230 relative to the chassis 210. This can be accomplished by configuring the controller 250 so as to modulate the speed of the actuator 240. For example, as in the case where the actuator 240 is an A/C electric motor, the controller can be configured so as to modulate the variable speed control unit 244 by way of a servo or the like.

The speed, or rate of movement, of the support surface 230 can affect the process of drying the product "P" which is performed by the apparatus 200. For example, a relatively slow speed of the support surface 230 can increase the amount of heat "H" which is absorbed by the product "P" because the slower speed will cause the product to be exposed to the heat "H" for a longer period of time. Conversely, a relatively fast speed of the support surface 230 can decrease the amount of heat "H" which is absorbed by the product "P" because the faster speed will result in less exposure time during which the product is exposed to the heat.

Moreover, the controller 250 can also be configured to regulate various qualities of the conditioned air "A" which can be made to circulate through the enclosure 246. For example, the controller 250 can be made to regulate the flow rate, relative humidity, and temperature of the conditioned air "A." These qualities of the conditioned air "A" can have an effect on both the drying time and quality of the product "P."

In another alternative embodiment of the apparatus 200 which is not shown, the enclosure 246 can be configured so as to be substantially sealed against outside atmospheric air. In that case, the chemical composition of the conditioned air "A" can be controlled so as to affect the drying process in specific manners, or to affect or preserve the chemical properties of the product "P." For example, the conditioned air "A" can substantially be inert gas which can act to prevent oxidation of the product "P."

Figure 5:
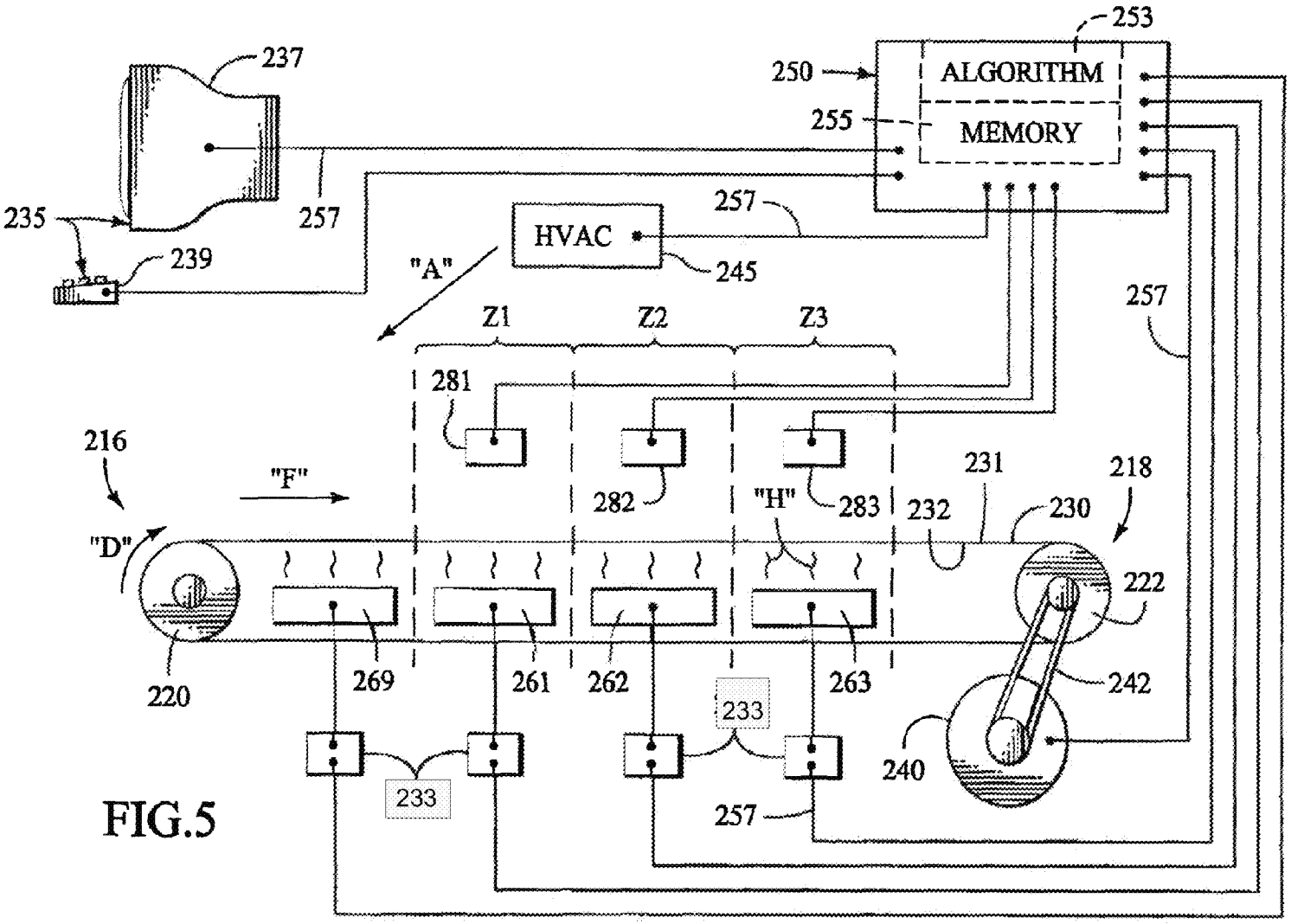
FIG. 5 is a schematic diagram showing one possible configuration of communication links between the various components of the apparatus depicted in FIG. 4.

Moving to FIG. 5, a schematic diagram is shown which depicts one possible configuration of the apparatus 200 which comprises a plurality of communication links 257. The communication links 257 are configured to provide for the transmission of data signals between the various components of the apparatus 200. The communication links 257 can be configured as any of a number of possible communication means, including those of hard wire and fiber optic. In addition, the communication links 257 can comprise wireless communication means including infrared wave, micro wave, sound wave, radio wave and the like.

A readable memory storage device 255, such as a digital memory, can be included within the controller 250. The readable memory device 255 can be employed to store data regarding the operational aspects of the apparatus 200 which are received by the controller by way of the communication links 257, as well as set points and other stored values and data which can be used by the controller 250 to control the drying process. The controller 250 can also include at least one algorithm 253 which can be employed to carry out various decision-making processes required during operation of the apparatus 200.

The decision-making processes taken into account by the algorithm 253 can include maintaining integrated coordination of the several variable control aspects of the apparatus 200. These variable control aspects comprise the speed of the support surface 230, the amount of heat "H" produced by each of the heat sources 261, 262, 263, 269, and the product characteristic measurements received from the sensors 281, 282, 283. Additionally, the algorithm 253 can be required to carry out the operational decision-making processes in accordance with various set production parameters such as a product temperature profile and production rate.

The communication links 257 can provide data transmission between the controller 250 and the operator interface 235 which can comprise a display screen 237 and a keypad 239. That is, the communication links 257 between the controller 250 and operator interface 235 can provide for the communication of data from the controller to the operator by way of the display screen. Such data can include various aspects of the apparatus 200 including the temperature and moisture content of the product "P" with regard to the position of the product within each of the control zones Z1, Z2, Z3.

Additionally, such data can include the speed of the support surface with respect to the chassis 210 and the temperature of each of the heat sources 261, 262, 263, 269. The communication links 257 can also provide for data to be communicated from the operator to the controller 250 by way of the keypad 239 or the like. Such data can include operational commands including the specification by the operator of a given product temperature profile.

A communication link 257 can be provided between the controller 250 and the HVAC unit 245 so as to communicate data there between. Such data can include commands from the controller 250 to the HVAC unit 245 which specify a given temperature, humidity, or the like, of the conditioned air "A." A communication link 257 can also be provided between the controller 250 and the actuator 240 so as to communicate data there between. This data can include commands from the controller 250 to the actuator which specify a given speed of the support surface 230.

Additional communication links 257 can be provided between the controller 250 and each of the sensors 281, 282, 283 so as to communicate data between each of the sensors and the controller. Such data can include measurements of various characteristics of the product "P" as described above for FIG. 4. Other communication links 257 can be provided between the controller 250 and each of the heat sources 261, 262, 263, 269 so as to provide transmission of data there between.

This data can include commands from the controller 250 to each of the heat sources 261, 262, 263, 269 which instruct each of the heat sources as to the amount of heat "H" to produce. As can be seen, the apparatus 200 can include a plurality of control devices 233, which can comprise electrical relays, wherein each one of the control devices is connected by way of respective communication links 257 to the controller 250. Each of the control devices can be configured in the manner of the control device 131 which is described above for FIG. 3.

In accordance with a seventh embodiment of the present invention, a method of drying a product includes providing a support surface which has a first side, and an opposite second side, and supporting the product on the first side while directing radiant heat toward product. Preferably, the support surface can allow radiant heat to pass there through so as to heat the product. The support surface can be a substantially flexible sheet. Alternatively, the support surface can be substantially rigid.

The method can further include the step of measuring a characteristic of the product, along with regulating the amount of radiant heat directed toward the second side as a function of the measured characteristic. The measured characteristic can include the temperature of the product, the moisture content of the product, and the chemical composition of the product. The characteristic can be detected and measured intermittently at given intervals, or it can be measured continually over a given time interval.

The method can also include moving the support surface so as to move the product past the heat source. Alternatively, the method can include moving the support surface so as to move the product through a plurality of control zones in succession, and providing a plurality of heat sources, wherein each control zone has at least one associated heat source dedicated exclusively to directing radiant heat within the associated control zone.

In other words, the method can include regulating the temperature of the heat sources within any given control zone independently of the temperature of any other heat sources outside the given control zone. This can allow producing and maintaining a given temperature profile of the product as the product is moved through the control zones.

The method can further include providing a plurality of sensors, wherein any given control zone has at least one sensor dedicated exclusively to detecting and measuring at least one characteristic of the product within the given control zone. This can allow regulating the temperature of each heat source in any given control zone as a function of at least one characteristic of the product within the given control zone. As noted above, the characteristics can include the temperature, moisture content, and chemical composition of the product, among others.

The rate of movement of the support surface relative to the control zones can also be regulated in accordance with the method. Additionally, an enclosure can be provided to aid in circulating conditioned air about the product as the product is processed by the apparatus. The quality of the conditioned air can be controlled, wherein such qualities can include the temperature, humidity, and chemical makeup of the conditioned air. The method can include annealing the product which the product is supported on the support surface.

Drying Apparatus with Movable Heaters

Another aspect of the present disclosure concerns a drying apparatus that is capable of independently controlling the temperature of the product being heated (e.g., to achieve a desired temperature profile) and the wavelength of the radiation (e.g., to maximize the heat transfer rate). To such ends, a drying apparatus can be provided with one or more heat sources that are movable relative to the product "P" in order to increase or decrease the gap or spacing between the heat source and the product "P". By adjusting the gap between the product and the heat source, it is possible to control the source temperature in such a manner that produces the desired product temperature and wavelength of radiation. For example, as noted above, if a particular drying profile requires that the temperature of the product remain substantially constant through one or more control zones, then the product typically is subjected to less heat in each successive control zone. To maintain the desired product temperature and wavelength of radiation, the heaters in a control zone can be moved farther away from the product to decrease the heat applied to the product while maintaining the source temperature to produce radiation at the desired wavelength. For example, if desired, the source temperature and heater positions can be controlled to produce a predetermined constant wavelength in successive zones to compensate for changes in energy required to evaporate moisture as the moisture content in the product decreases as it is dried through each of the zones.

Alternatively, if desired, the source temperature can be adjusted to produce a desired wavelength in a control zone that is different than the wavelength in the preceding control zone and the gap between the heat source and the product can be adjusted accordingly to achieve the desired product temperature. This allows the dryer to compensate for other product characteristics that can vary in each zone or from zone to zone during the drying process, such as the emissivity of the product, the thickness of the product, changes in sensitivity of the product (or specific compounds in the product) to a particular wavelength of IR (infrared radiation), and the ability to release bound moisture in the product (the ability to release bound moisture decreases as the product is dried). The controller of the dryer can be configured to continuously monitor the wavelength of the heat sources and the temperature of the product during the drying process, and automatically adjust the temperature and the positions of the heat sources to maintain the desired product temperature and wavelength within each heating zone.

Figure 6:
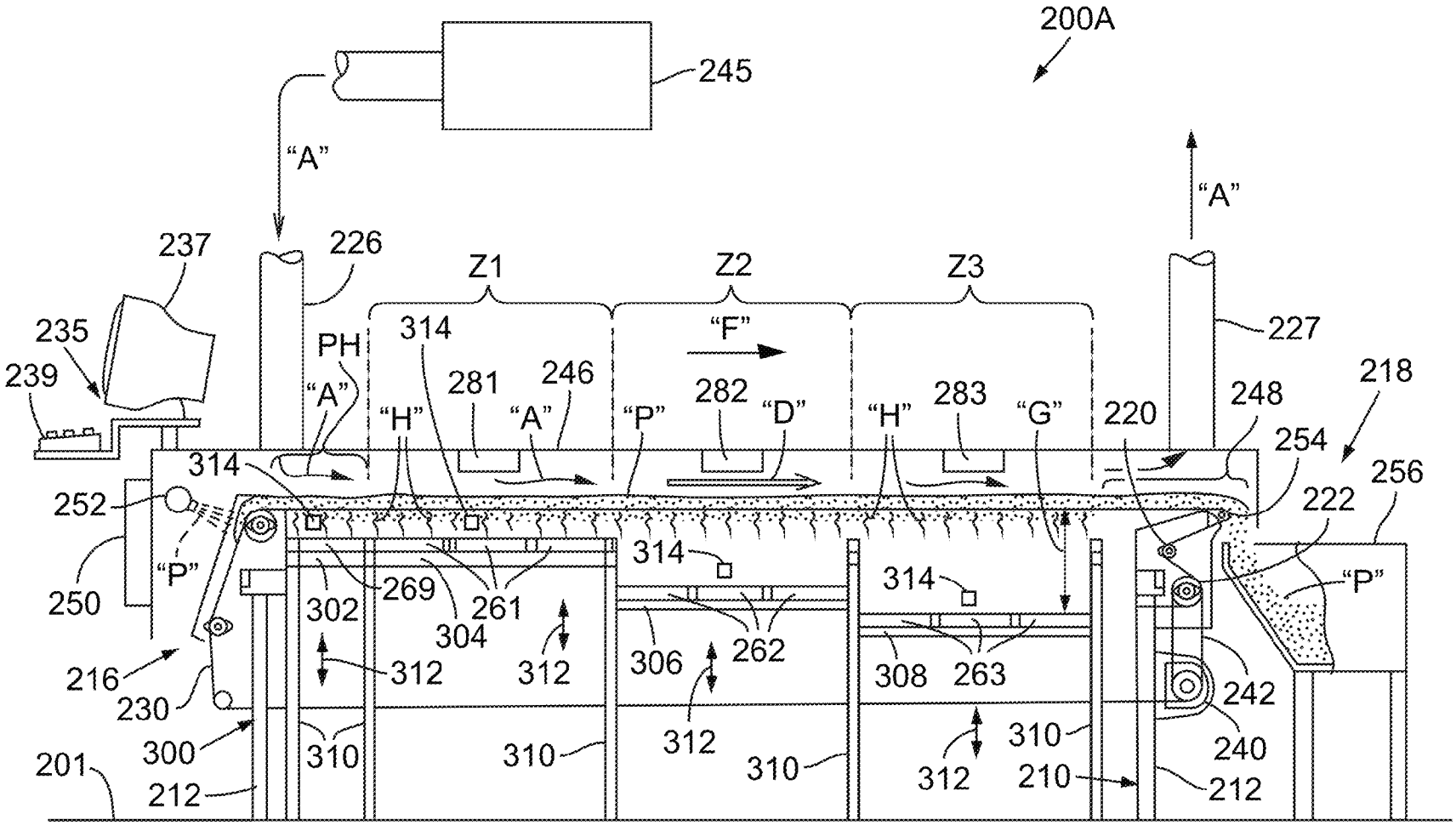
FIG. 6 is a side elevation diagram of an apparatus in accordance with an eighth embodiment.

Referring now to FIG. 6, there is shown a drying apparatus 200A, according to an eighth embodiment of the present disclosure. The drying apparatus 200A is a modification of the drying apparatus 200 of FIGS. 4 and 5. One difference between the drying apparatus 200A and the drying apparatus 200 is that the drying apparatus 200A has heat sources that are movable upwardly and downwardly relative to the product "P". The drying apparatus 200A includes a chassis 300 that is modified relative to the chassis 210 of FIG. 4 in that it includes movable platforms, or heater supports, 302, 304, 306, 308 that support heat sources 269, 261, 262, 263, respectively. The heat sources 269, 261, 262, 263 can comprise heating elements that produce radiant heat in the infrared spectrum. Each platform 302, 304, 306, 308 is mounted on a pair of upright legs 310 of the chassis 300 and is configured to move upwardly and downwardly relative thereto, as indicated by double-headed arrows 312.

In particular embodiment, each heater support supports a set of one or more quartz heating elements for producing infrared radiation. Each such heating element can comprise a coiled wire encased in quartz tubing. The quartz tubing can be frosted, as known in the art, to increase the heat capacitance of the heating element. The quartz tubing can include additives, such as silicon or graphite, to further increase the heat capacitance of the heating element. Increased heat capacitance can provide better control of the operating temperature of the heating element, such as if an "on/off" type switch or relay is used to modulate current to the heating elements.

As shown in FIG. 6, each heat source within a control zone Z1, Z2, or Z3 is supported on a common platform, and therefore each heat source within a specific control zone moves upwardly and downwardly together. In alternative embodiments, less than three heat sources can be mounted on a single platform. For example, each heat source can be mounted on a separate platform and its vertical position can be adjusted relative to other heat sources within the same control zone. In still other embodiments, a single platform can extend into multiple zones to support heat sources in adjacent control zones.

Mounted within each heating zone (control zones Z1, Z2, Z3 and pre-heat zone PH) directly above a heat source are one or more temperature-sensing devices to measure the temperature of the heat sources, such as one or more thermocouples 314. Each thermocouple 314 is positioned to monitor the surface temperature of the heating elements of a corresponding heat source and is in communication with the controller 250 (FIG. 5). As described in greater detail below, a feedback control loop is provided to continuously monitor the temperature of the heat sources within each heating zone and adjust the vertical position of the heat sources and/or the temperature of the heat sources to achieve a predetermined wavelength and a predetermined product temperature using radiant energy. In the illustrated embodiment, one thermocouple is located within each heating zone. However, in other embodiments, more than one thermocouple can be used in each heating zone. For example, if each heat source is mounted on its own platform, then it would be desirable to position at least one thermocouple above each heat source. A thermocouple 314 can be mounted at any convenient position adjacent the heating elements of a corresponding heat source. For example, a thermocouple can be mounted to the support frame or pan of a heat source that supports one or more heating elements.

In lieu of or in addition to thermocouples, the dryer can include in each heating zone one or more sensors, such as an infrared spectrometer or radiometer, for measuring the energy or the wavelength of infrared energy that reaches the product. Such sensors can be mounted at any convenient locations on the dryer, such as directly above the support surface 230 and the product, preferably directly above an edge portion of the support surface that is not covered by the layer of product. This method has the advantage of allowing the system to compensate for changes in the actual IR wavelength reaching the product that can vary due to the transparency and refractive properties of the support surface 230, as well as IR energy that is emitted from the heater pan surfaces or from reflectors in the heater pans. The wavelength or energy sensors can replace the heater thermocouples 314 (or can be used in combination with the thermocouples) as a means to determine the wavelength of radiant energy emitted from the heat sources in a control scheme whereby the vertical positions of the heat sources and/or their temperatures are adjusted to achieve a predetermined wavelength and a predetermined product temperature within each zone.

Figure 7:
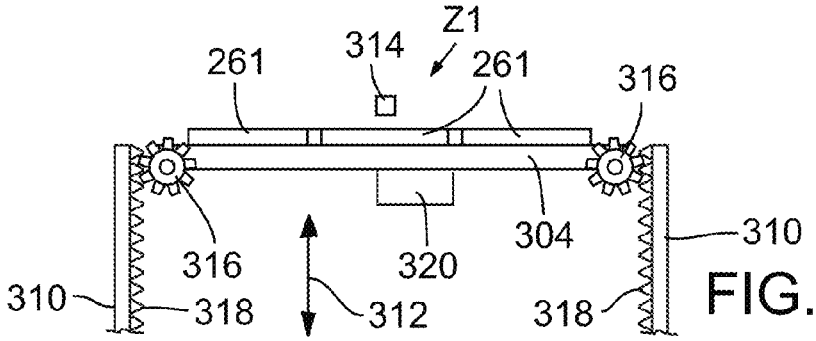
FIG. 7 is an enlarged, schematic side elevation diagram of one of the movable heater supports of the apparatus depicted in FIG. 6.

Any suitable techniques or mechanisms can be used to effect vertical movement of each platform 302, 304, 306, 308 relative to support legs 310. FIG. 7, for example, is a schematic illustration of control zone Z1 showing platform 304 having drive gears 316 mounted on opposite sides of the platform. Each drive gear 316 engages a respective rack gear 318 mounted on a respective support leg 310 of the chassis. The drive gears 316 can be powered by an electric motor 320 mounted at a convenient location on the platform. The motor 320 can be operatively coupled to each drive gear 316 by a drive shaft (not shown) such that operation of the motor is effective to drive the drive gears, which translate along the rack gears to move the platform upwardly or downwardly. The motor 320 is in communication with the controller 250 (FIG. 5), which controls the vertical position of the platform. The platforms of the other heating zones can have a similar configuration.

Figure 9:
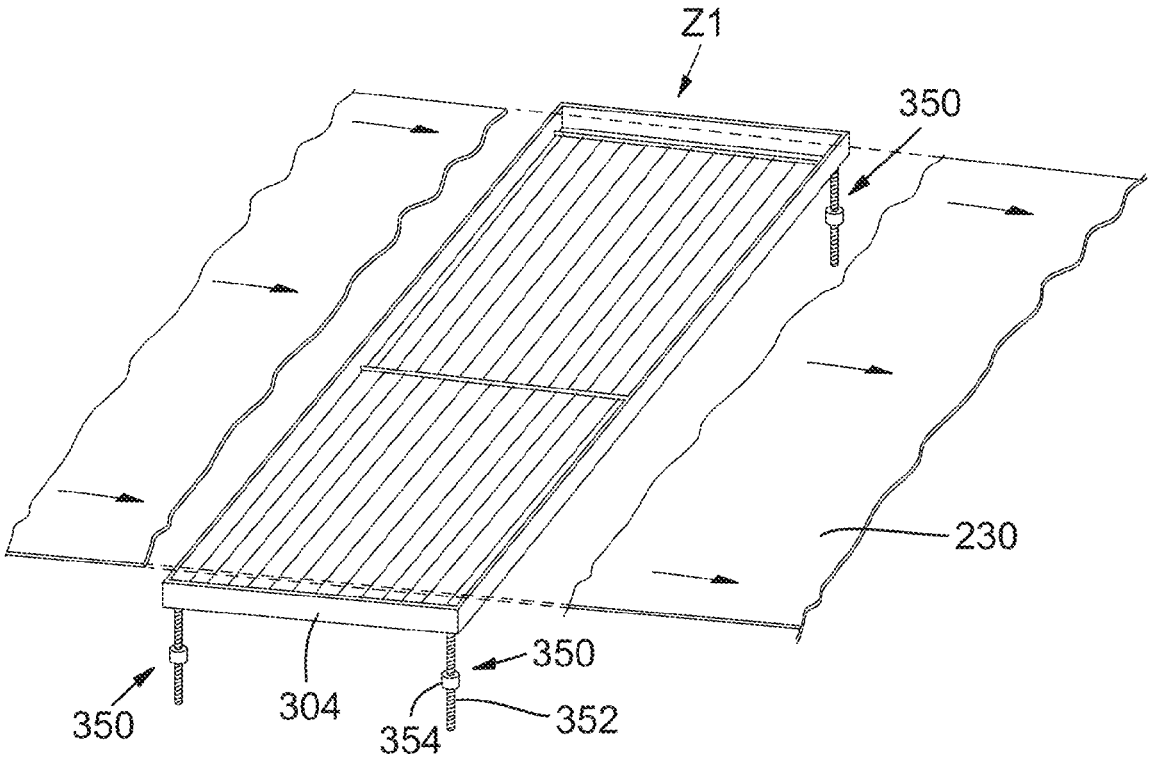
FIG. 9 is a perspective, schematic view of a movable heater support, according to another embodiment.

FIG. 9 shows an alternative configuration for effecting vertical movement of a platform. In this embodiment, a platform 304 is mounted to four linear actuators 350 (one mounted at each corner of the platform), although a greater or fewer number of actuators can be used. Each actuator 350 in the illustrated embodiment comprises a threaded shaft 352 and a nut 354 disposed on the shaft. The platform 304 is supported on the upper ends of the shafts 352. Synchronized rotation of the nuts 354 (controlled by the controller 350) causes the platform 304 to be raised or lowered relative to the conveyor 230. It should be noted that various other mechanisms can be used to effect vertical movement of the platforms. For example, any of various pneumatic, electromechanical, and/or hydraulic mechanisms can be used to move a platform upwardly and downwardly, including various types of linear actuators, screw motors, screw rails, and the like.

As can be appreciated, adjusting the vertical position of the heat source(s) on a platform adjusts the gap or spacing G between the heat source(s) and the product "P" supported on the support surface 230. The temperature of the product varies according to the distance between the heat source and the product, as well as the temperature of the heat source. Increasing the distance from the heat source to the product will decrease the temperature of the product while decreasing the distance from the heat source to the product will increase the temperature of the product (if the temperature of the heat source remains constant). As noted above, the wavelength of radiant energy emitted from a heat source can be increased and decreased by decreasing and increasing, respectively, the temperature of the heat source. Accordingly, the temperature of the product "P" within a heating zone and the wavelength of radiant energy absorbed by the product within that heating zone can be independently controlled by adjusting the temperature of the heat source(s) and the distance between the heat source(s) and the product.

In particular embodiments, the controller 250 can be configured to continuously monitor the temperature of the product (and/or other characteristics of the product) via sensors 281, 282, 283 and the temperature of the heat sources via the thermocouples 314 and to automatically adjust the vertical position of the heat sources and/or the temperature of the heat sources to maintain a predetermined temperature profile for the product and a predetermined wavelength of radiant energy in each heating zone. In order to determine the wavelengths of radiant energy from the heat sources, the controller 250 can include an algorithm or look-up table that is used by the controller to determine the wavelength corresponding to each heat source based on the temperature readings of the thermocouples 314 that are relayed to the controller.

Figure 10:
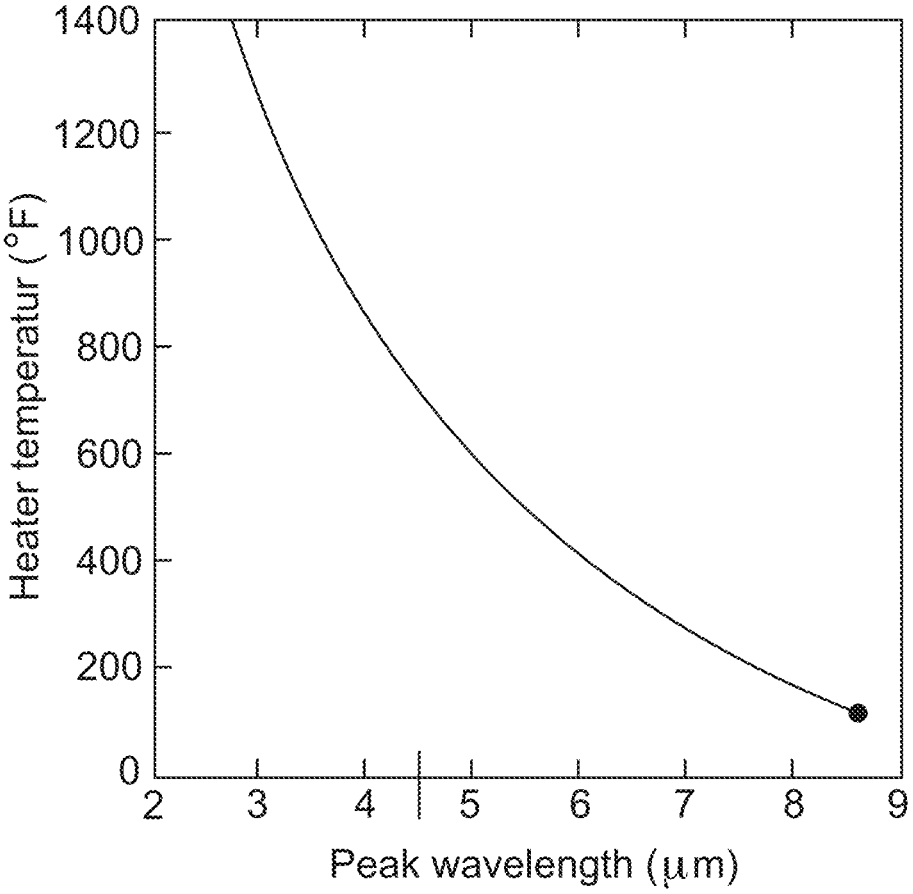
FIG. 10 is a line graph showing the relationship between the operating temperature of a quartz heating element and the peak wavelength of infrared radiation emitted by the heating element.

In one implementation, the wavelength of a heat source can be determined by measuring the temperature of the heat source and calculating the wavelength using Wien's law ($\lambda max=b/T$, where $\lambda max$ is the peak wavelength, b is Wien's displacement constant and T is the temperature of the heat source). In another implementation, the wavelength of a heat source can be determined by measuring the temperature of the heat source and identifying the corresponding peak wavelength of the heat source on a graph, such as illustrated in FIG. 10. Alternatively, the dryer can include wavelength sensors (as discussed above) that directly monitor the wavelengths of radiant energy from each heat source and relay signals to the controller.

The controller 250 can be in communication with a plurality of control devices 233 (FIG. 5) that control the temperatures of the heating elements in each zone. Desirably, a control device 233 is provided for each zone of the dryer. For example, the control devices 233 can be solid state relays that modulate electric current to the heating elements by employing an "on/off" control scheme. More desirably, the control devices 233 comprise phase angle control modules that can increase or decrease the temperature of the heating elements by varying the voltage to the heating elements. Each phase angle control module 233 is in communication with the controller 250 and, based on signals received from the controller, varies the input voltage to the heating elements of a respective zone in order to raise or lower the operating temperature of the heating elements. The use of phase angle control modules 233 is advantageous in that it allows precise control over the operating temperatures of the heating elements in order to better achieve the desired product temperature profile.

Figure 11:
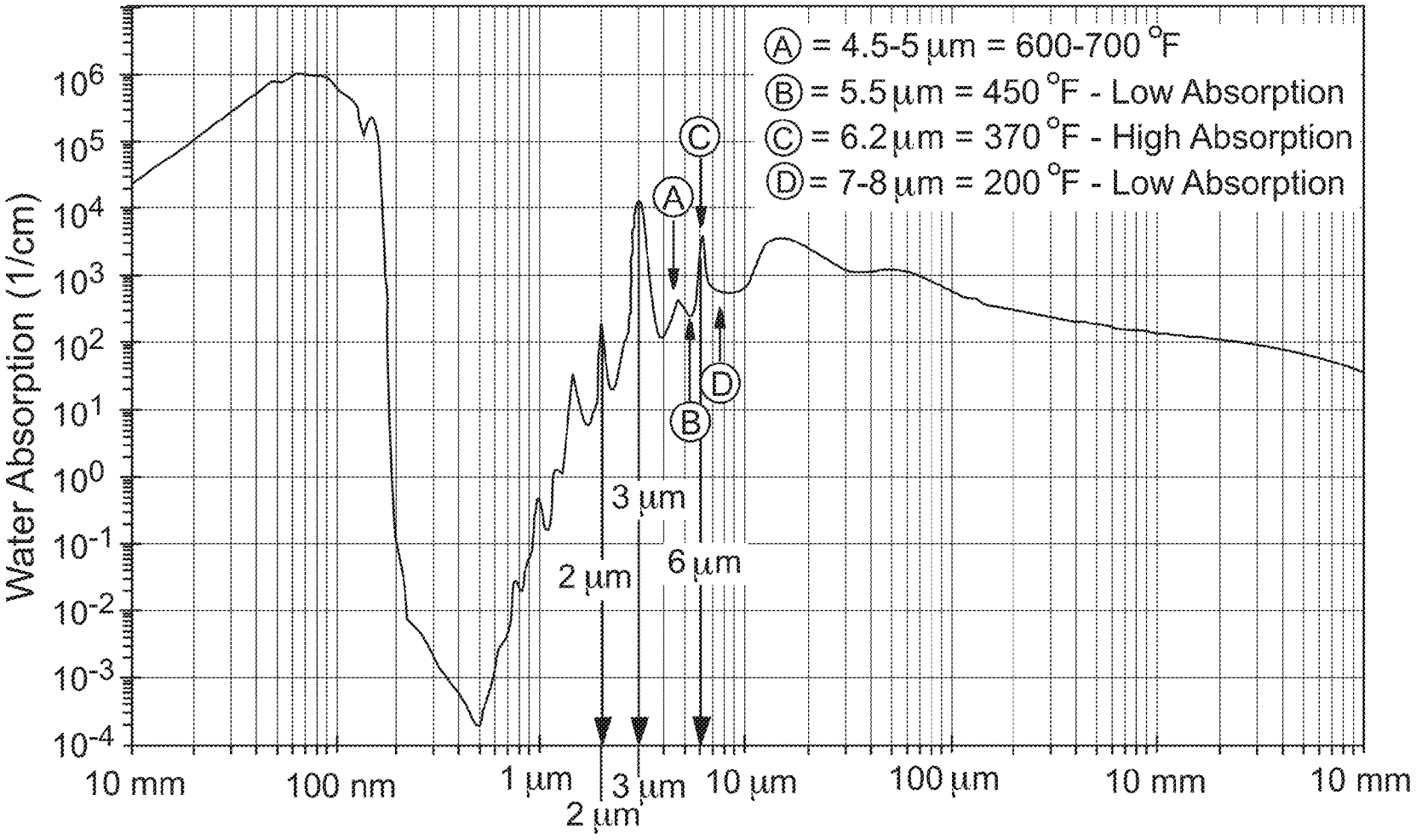
FIG. 11 is a chart showing the absorption of electromagnetic radiation by water across a range of wavelengths.

The wavelength of infrared waves emitted from the heat sources in each zone can be selected based on the desired heating and drying characteristics for a particular product in a particular stage of drying as well as various product characteristics, such as the emissivity and the ability to absorb radiant heat. For example, the wavelength in each heating zone can be selected to maximize the radiant energy absorption rate in each heating zone for a particular product. FIG. 11 shows the absorption of electromagnetic radiation by water. In the infrared range, there is a peak at about 3 μm and at about 6.2 μm. In one specific implementation, it may be desirable to maintain a constant wavelength throughout the drying process at 3 or 6.2 μm for optimum absorption of the IR energy by the water in the product being evaporated. Because the moisture content of product applied to the support surface 230 varies as does the moisture in the product as it moves through each heating zone (as well as other product characteristics), the amount of heat required to achieve a desired product temperature in each zone can vary substantially. Consequently, the positions of the heat sources can be automatically adjusted to maintain a predetermined constant wavelength and a predetermined temperature profile. Moving the heaters produces a constant wavelength to compensate for changes in moisture content in the product during drying, and to compensate for different desired product temperature set-points in each drying zone (i.e., the desired drying temperature profile, which can vary for different products). In some cases it may be desirable to operate some heat sources at 3 μm in some drying zones (such as in the early zones where relatively higher temperatures are needed) and at 6.2 μm in other drying zones (such as in zones towards the end of the dryer where relatively lower temperatures are needed). In this manner, the specific wavelength (3 or 6.2 μm) for each zone can be selected based on whether the zone has any specific temperature limitations or requirements.

In other implementations, it may be desirable to change the wavelength in each successive zone for one or more reasons. For example, the emissivity of the product as a whole may change as it proceeds through the drying process. As such, the wavelength in each heating zone can be selected to maximize absorption of radiant energy by the product as the emissivity of the product changes during the drying process. As another example, the wavelength in each heating zone can be selected to achieve a desired degree of penetration of radiant waves into the product or to compensate for changes in thickness of the product layer as it dries. Moreover, the sensitivity of the product (or a particular compound in the product) to a particular wavelength of IR may increase as the product moves through the dryer. Thus, the wavelength in each heating zone can be selected to avoid damage to the product or particular compounds in the product.

The following describes one specific approach for operating the dryer 200A to dry a product using a predetermined wavelength of IR. As noted above, infrared wavelengths of about 3 microns and 6.2 microns generally produce the best radiant energy absorption rate for water. Thus, the controller 250 can be programmed to control the temperature of the heat sources in each heating zone to produce infrared waves at, for example, 3 microns (or alternatively, 6.2 microns) across all heating zones. To maintain a predetermined temperature profile for the product, the controller 250 monitors the temperature of the product and continuously adjusts the spacing between the heat sources and the product as needed to maintain the desired temperature of the product within each zone. As discussed above, for drying certain products it is desirable to maintain a constant product temperature across zones Z1, Z2, Z3. Since the moisture content of the product decreases as the product moves through each zone, less heat is needed in each successive zone to maintain the desired product temperature. As such, the heat sources in the first control zone Z1 typically are closer to the product than the heat sources in the second control zone Z2, which typically are closer to the product than the heat sources in the third control zone Z3, as depicted in FIG. 6. As can be appreciated, the heat sources can operate at constant, or substantially constant operating temperatures, and the controller can cause the positions of the heat sources to move upwardly or downwardly to vary the amount of heat reaching the product. An advantage of operating the heat sources at constant or substantially constant operating temperatures is that the heat sources can be operated at constant or substantially constant power supply and voltage, which can significantly increase the energy efficiency of the dryer.

Figure 8:
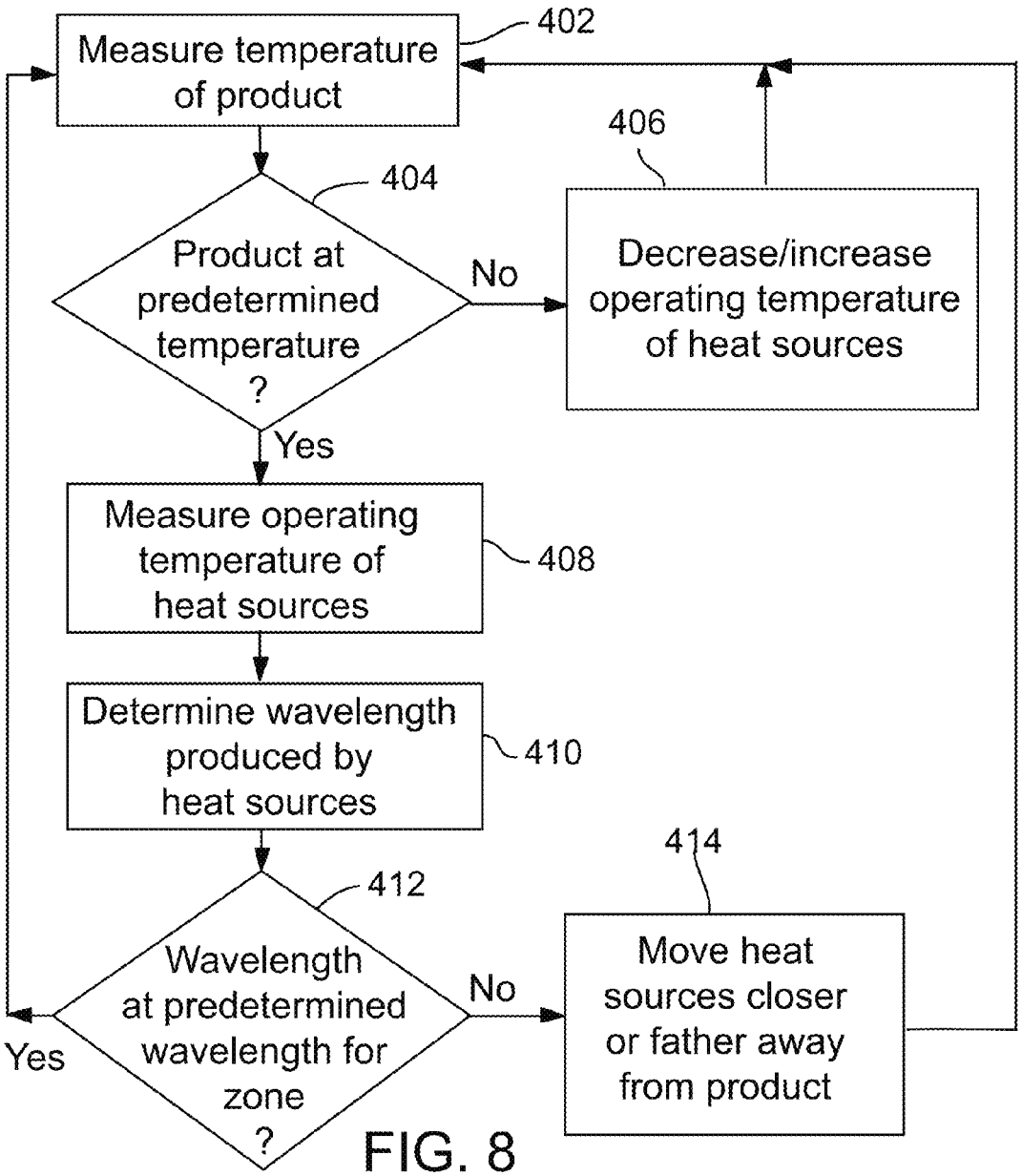
FIG. 8 is a flowchart illustrating a method for operating the drying apparatus shown in FIG. 6.

An alternative control scheme for operating drying apparatus 200A is illustrated in the flowchart shown in FIG. 8 and can operate in the following manner. When the dryer is initially started and product is first applied to the support surface 230, the heat sources are in a starting position (usually, but not necessarily, all of the heat sources are at the same vertical position). Referring to FIG. 8, the controller first reads the product temperature (402) and adjusts the operating temperatures of the heat sources accordingly to achieve the desired product temperature in each heating zone (404 and 406). If the product temperature is at the predetermined set-point for the product in a particular zone, then the controller reads the operating temperature of the heat sources and determines the wavelength produced by the heat sources in that zone (408 and 410). Alternatively, the wavelength in the heating zone can be determined from signals relayed to the controller from a spectrometer, radiometer, or equivalent device.

If the wavelength in a particular zone is greater or less than a predetermined wavelength, the controller controls the heat sources in that zone to move farther away from or closer to the product (412 and 414). More specifically, if the measured wavelength is greater than the predetermined wavelength, then the controller causes the heat sources to move farther away from the product, and if the measured wavelength is less than the predetermined wavelength, then the controller causes the heat sources to move closer to the product. As the heat sources move farther away from or closer to the product, the product temperature may begin to decrease or increase, respectively. Consequently, the process loop starts over at block 402 where the controller reads the product temperature and increases or decreases the operating temperature of the heat sources until the predetermined product temperature is again achieved. At this point, the controller again determines the wavelength produced by the heat sources (408 and 410) and causes the heat sources to move even farther away from or closer to the product if the wavelength is still greater or less than the predetermined wavelength for that zone (412 and 414). This process loop is repeated until the heat sources produce energy at the predetermined wavelength. At this point, the controller again determines the product temperature (402 and 404), adjusts the operating temperature of the heat sources as needed to maintain the predetermined product temperature (406), and then compares the measured wavelength to the predetermined wavelength (410 and 412) and moves the heat sources if the measured wavelength is greater or less than the predetermined wavelength (414).

When the controller determines that the heat sources in a zone should be moved (either upwardly or downwardly), the heat sources can be moved in small, predetermined increments at block 414. After each incremental movement, the controller reads the product temperature (402), increases or decreases the operating temperature of the heat sources to achieve the predetermined product temperature (406), and once the predetermined product temperature is achieved (404), the controller determines the wavelength produced by the heat sources (408 and 410), and then causes the heat sources to move another increment if the wavelength is longer or shorter than the predetermined wavelength (414).

The manner of operating the dryer illustrated in FIG. 8 can improve the responsiveness of the dryer (i.e., the ability of the system to increase or decrease the amount of heat applied to the product as needed to avoid overheating or underheating the product) compared to a control scheme where the heating elements are maintained at a constant temperature and are raised and lowered to adjust the amount of heat applied to the product. The method shown in FIG. 8 therefore includes two feedback loops, namely, a first feedback loop that adjusts the temperature of the heating elements in response to sudden changes that necessitate an immediate increase or decrease in the amount of heat applied to the product, and a second feedback loop that adjusts the positions of the heating elements until the targeted wavelength is achieved at the optimum product temperature. A variety of process characteristics vary during the drying process and can cause a demand for a sudden increase or decrease in the amount of heat that must be applied to the product in order to maintain the targeted temperature profile of the product. Some of these characteristics include the moisture and solids content of product applied to the conveyor, the initial product temperature, the rate and thickness of product applied to the conveyor, and ambient conditions (temperature and relative humidity). Operating two feedback loops in the manner described allows the operating temperatures of the heating elements to be increased and decreased quickly in order to respond to a demand for an increase or decrease in the amount of heat applied to the product so as to avoid overheating or underheating the product.

In another implementation, the controller 250 can be programmed to increase and decrease the temperature of a heat source within a predetermined temperature range that corresponds to an acceptable wavelength spectra prior to adjusting the position of the heat source. For example, the controller 250 can monitor product temperature and adjust the temperature of a heat source within a predetermined range as is needed to maintain the temperature profile. If the temperature of the heat source exceeds or drops below the predetermined range, the controller can then move the heat source closer to or farther away from the product as needed to maintain the temperature profile for the product. This manner of operating the dryer allows for very rapid responses from the heat sources to changes in the amount of heat required to achieve a desired product temperature in each drying zone. Explaining further, a target temperature is selected for each heater to achieve a desired wavelength, but in order to respond rapidly, the temperature of the heater is varied within a specified and limited range within an acceptable band of wavelengths. This allows the heat sources to respond rapidly to small, real time changes in in the product being dried, such as changes in moisture content or product thickness that may occur frequently, thereby avoiding overheating or underheating of the product.

In the illustrated embodiment, the controller 250 operates in a first feedback loop to control the temperature of the heat sources and in a second feedback loop to control the spacing of the heat sources relative to the product. In alternative embodiments, the temperature of the heat sources and their positions relative to the product can be manually adjusted by an operator. For example, the operator can monitor the various operating parameters of the process (product temperature, heat source temperature, etc.) and make adjustments to one or more of the operating parameters by inputting the information into the keypad 269, which information is relayed to the controller 250.

The drying apparatus 200A in the illustrated embodiment is described in the context of drying a thin layer of liquid product. It should be understood that all of the embodiments of drying apparatus disclosed herein can be used to dry or otherwise apply heat to non-fluid food products (e.g., baked goods, rice) or any of various non-food products (e.g., wood products, sludge, film board, textiles, adhesives, inks, photosensitive layers, etc.).

EXAMPLE 1

Dehydrating Beet Juice Concentrate

Example 1 demonstrates the improved capacity that can be achieved by adjusting the position of the heaters relative to the product conveyor and the output of the heaters. In this example, a drying apparatus having 16 zones was used to dehydrate beet juice concentrate in a first drying run and a second drying run. The dehydrated beet juice concentrate was processed into powder form. Tables 1 and 2 show the zone settings of the dryer in the first and second runs, respectively. The heater distance in Tables 1 and 2 represents the distance between the heating elements and the conveyor in each zone. Table 3 show other dryer operating parameters and product characteristics for the first and second runs. The product set points across all zones (which determines the product temperature profile) were the same in each run. However, in the first drying run, the position of the heaters were manually adjusted prior to dryer operation in order to cause the heaters to emit infrared radiation at or around 6.2 μm (corresponding to peak "C" in FIG. 11). In the second drying run, the position of the heaters were manually adjusted prior to dryer operation in order to cause the heaters to emit infrared radiation at or around 7.0 μm (corresponding to peak "D" in FIG. 11). The wavelength of infrared radiation in each zone was determined by measuring the temperature of the heating elements and calculating the wavelength using Wien's law.

Figure 12:
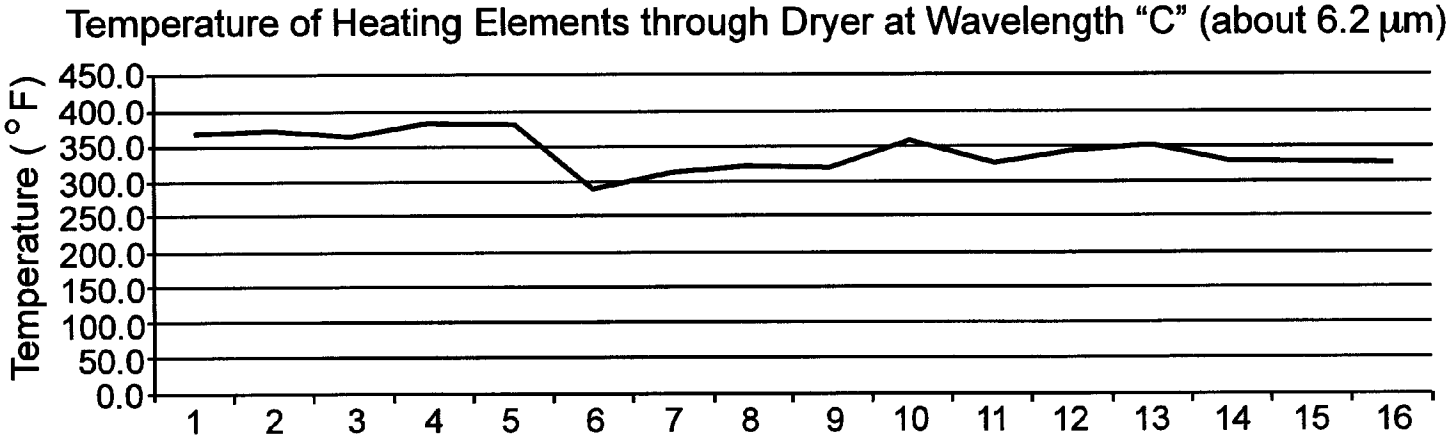
FIGS. 12-14 show the temperature of the heating elements in each zone of a dryer under different operating conditions for dehydrating beet juice concentrate.
Figure 13:
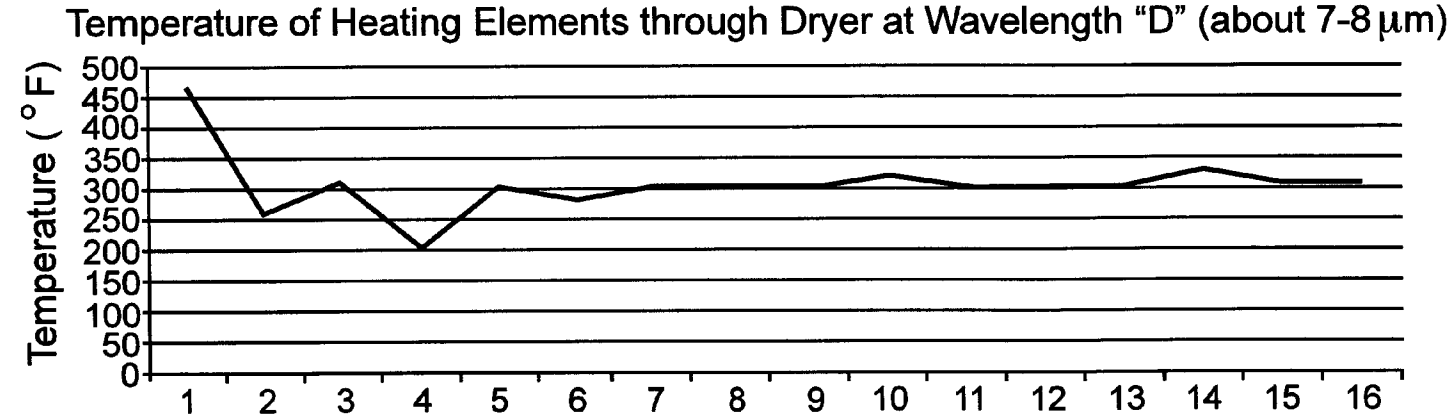
Figure 14:
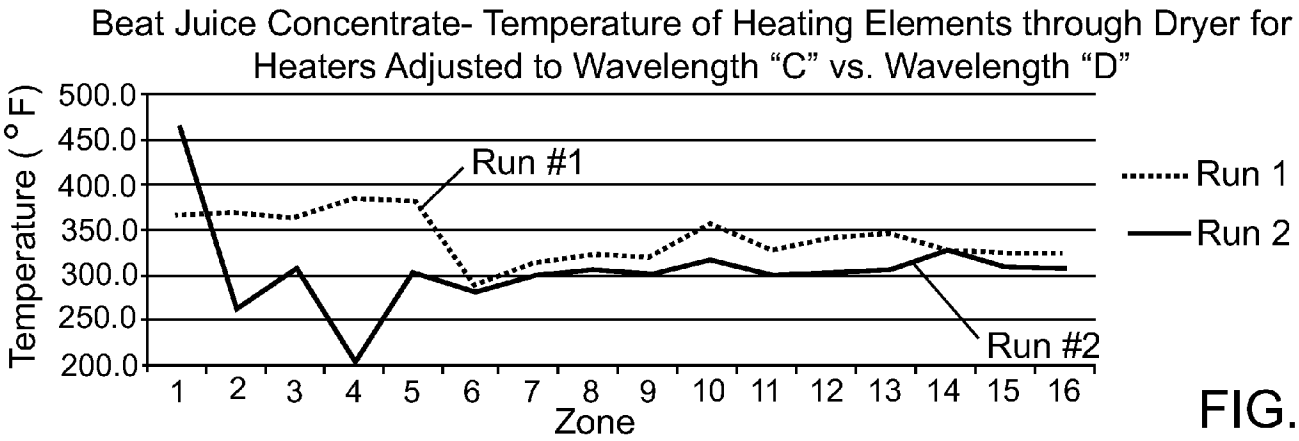
Figure 15:
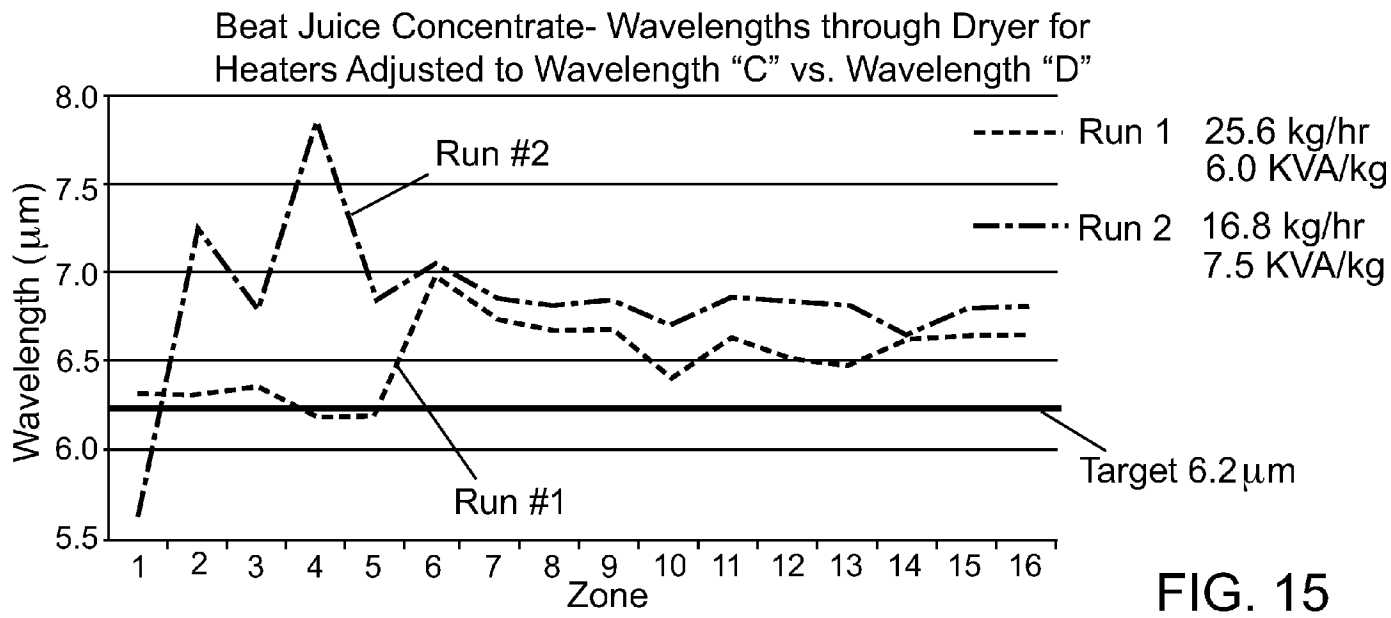
FIG. 15 shows the wavelength of infrared radiation measured in each zone of a dryer under different operating conditions for dehydrating beet juice concentrate.
Figure 16:
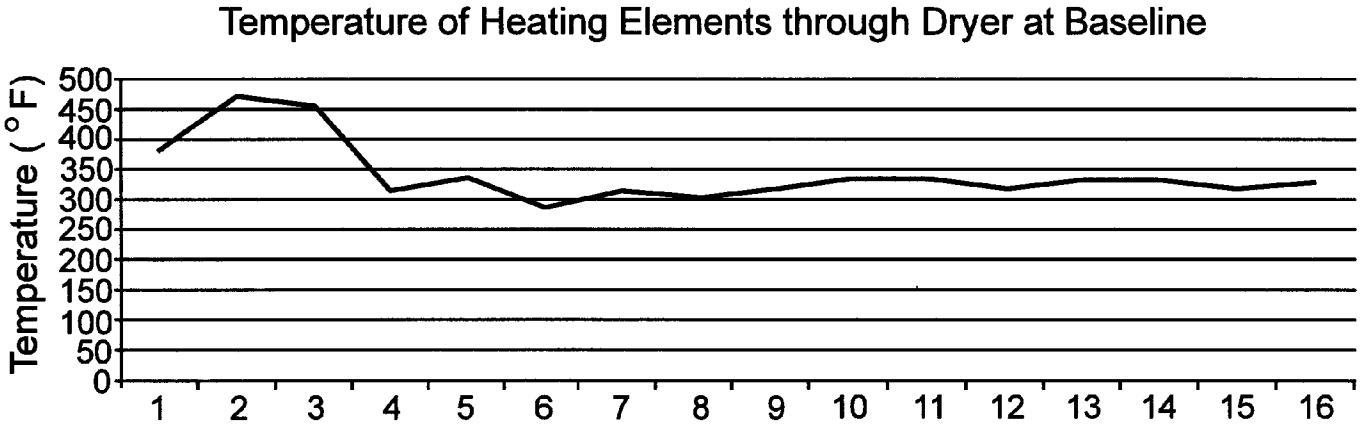
FIGS. 16-20 show the temperature of the heating elements in each zone of a dryer under different operating conditions for dehydrating a fruit puree blend.
Figure 17:
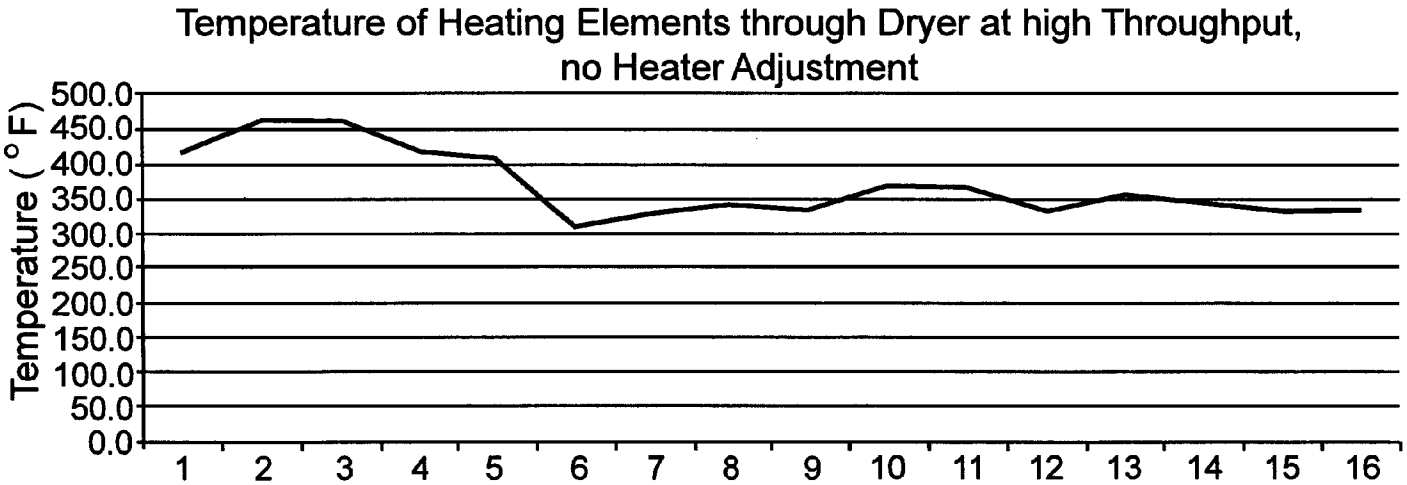
Figure 18:
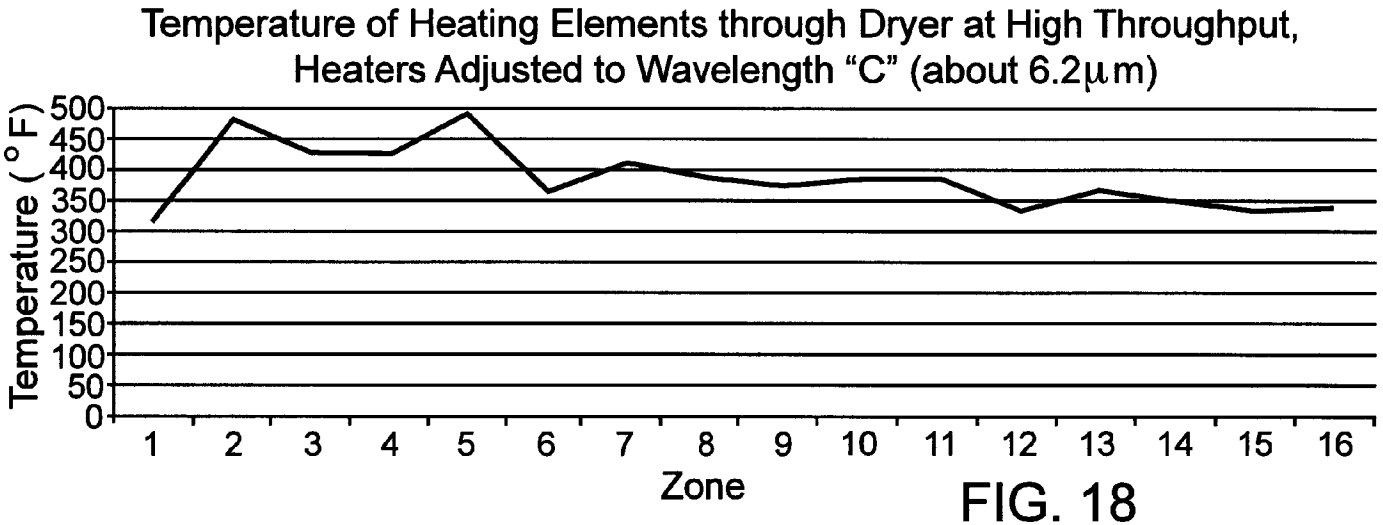
Figure 19:
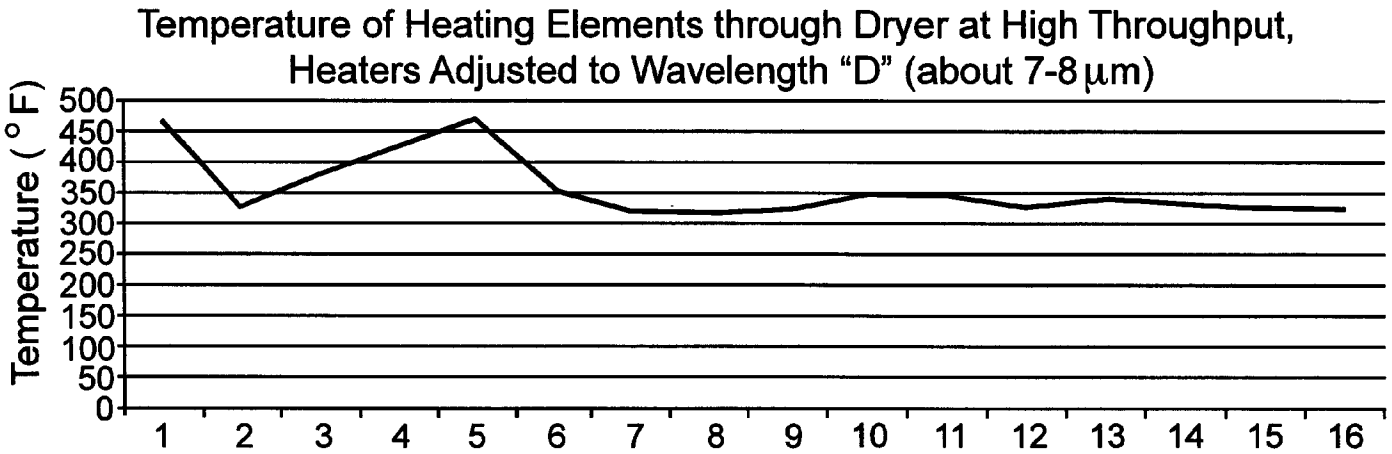

FIG. 12 shows the temperature of the heating elements in each zone of the dryer during the first drying run. FIG. 13 shows the temperature of the heating elements in each zone of the dryer during the second drying run. FIG. 14 shows the graphs of FIGS. 12 and 13 on one chart. FIG. 15 shows the measured wavelength of IR radiation in each zone for first and second drying runs.

Example 1 demonstrates that even with manually positioning of the heaters, the product temperature and wavelength of the heaters can be independently controlled. A much greater degree of precision in controlling the wavelength of infrared radiation across all zones can be achieved by continuous and automatic adjustment of temperatures of the heating elements and the position of the heating elements relative to the conveyor. Table 4 compares the throughput (drying capacity) and the energy usage of the two drying runs. It can be seen from the results of Table 4 that targeting 6.2 μm across all zones (drying run 1) resulted in a 53% increase in drying capacity over targeting 7.0 μm across all zones (drying run 2). Further, drying run 1 used less energy per kilogram of product dried than in drying run 2, most likely because energy was more efficiently absorbed by the water in the product (which causes the product to release moisture).

Most importantly, Example 1 shows that an extremely high product quality can be achieved (as evidenced by the moisture content in both drying runs) by drying the product at the predetermined temperature profile while the drying capacity of the dryer can be increased substantially by operating the heating elements at a predetermined wavelength. In other words, the capacity of the dryer can be significantly improved by operating the heating elements at a predetermined infrared wavelength that maximizes the absorption of infrared radiation into the product, while also maintaining high product quality by precisely controlling the temperature of the product as it is dried. When dehydrating liquid food products, such as fruit or vegetable liquids, it is important to produce a high quality product that is low in moisture content (for improved flowability and shelf life) with minimal nutritional loss.

TABLE 1

| Drying Run #1 - Zone Settings | | | | | | | | | | | | | | | | |
|---|---|---|---|---|---|---|---|---|---|---|---|---|---|---|---|---|
| Zone | 1 | 2 | 3 | 4 | 5 | 6 | 7 | 8 | 9 | 10 | 11 | 12 | 13 | 14 | 15 | 16 |
| Product set point temp. (° F.) | 97 | 105 | 113 | 113 | 130 | 145 | 160 | 165 | 165 | 165 | 170 | 175 | 180 | 180 | 180 | 180 |
| Heater Temp (F.) | 366 | 367 | 363 | 382 | 287 | 313 | 321 | 321 | 356 | 328 | 340 | 345 | 329 | 326 | 325 | 325 |
| Heater distance (in) | 2.9 | 2.9 | 2.9 | 2.9 | 6.4 | 6.4 | 8.9 | 8.9 | 8.9 | 8.9 | 8.9 | 8.9 | 8.9 | 8.9 | 8.9 | 8.9 |
| Wavelength (um) | 6.3 | 6.3 | 6.3 | 6.2 | 6.2 | 6.9 | 6.8 | 6.7 | 6.7 | 6.4 | 6.6 | 6.5 | 6.5 | 6.6 | 6.6 | 6.6 |

TABLE 2

| Drying Run #2 - Zone Settings | | | | | | | | | | | | | | | | |
|---|---|---|---|---|---|---|---|---|---|---|---|---|---|---|---|---|
| Zone | 1 | 2 | 3 | 4 | 5 | 6 | 7 | 8 | 9 | 10 | 11 | 12 | 13 | 14 | 15 | 16 |
| Product set point temp. (° F.) | 97 | 105 | 113 | 113 | 130 | 145 | 160 | 165 | 165 | 165 | 170 | 175 | 180 | 180 | 180 | 180 |
| Heater Temp (F.) | 464 | 260 | 307 | 204 | 301 | 280 | 300 | 304 | 301 | 317 | 299 | 301 | 305 | 327 | 308 | 305 |
| Heater distance (in) | 6.5 | 6.5 | 6.5 | 6.5 | 6.5 | 6.5 | 2.6 | 2.6 | 2.9 | 2.9 | 2.9 | 2.9 | 2.4 | 2.4 | 2.6 | 2.6 |
| Wavelength (um) | 5.6 | 7.2 | 6.8 | 7.9 | 7.0 | 7.0 | 7.0 | 6.8 | 7.0 | 6.7 | 6.9 | 7.0 | 6.8 | 6.6 | 6.8 | 6.8 |

TABLE 3

| | Drying Run #1- Heaters Adjusted to Peak "C" | Drying Run #2- Heaters Adjusted to Peak "D" |
|---|---|---|
| Time | 1 hour | 1 hour |
| Ambient conditions | 73.3 F., 45% RH | 71.3 F., 51% RH |
| Initial product temp | 41 F. | 42 F. |
| Solids | 45% | 45% |
| Average water activity | .279 | .273 |
| Average moisture at 104 F. | 1.12% | 1.23% |
| Average moisture at 90 F. | 0.69% | 0.80% |
| Average product thickness (mm) | 0.08 | 0.08 |
| Throughput (kg/hr) | 25.6 | 16.7 |
| Total power (KVA) | 154.4 | 126 |
| Power per kg product (KVA/kg) | 6.0 | 7.5 |

TABLE 4

| Results Summary for Beet Juice Concentrate | | | |
|---|---|---|---|
| Drying run (beet juice concentrate) | Target Wavelength | Throughput (kg/hr) | Energy (KVA) used per kg of product |
| 1 | Peak "C" (about 6.2 μm) | 25.6 | 6.0 |
| 2 | Peak "D" (about 7-8 μm) | 16.7 | 7.5 |

EXAMPLE 2

Dehydrating Fruit Puree Blend

In Example 2, a 16-zone dryer was used to dry a fruit puree blend comprising a mixture of grape puree and blueberry puree. The fruit puree blend was dried in four separate drying runs all having the same product temperature set points. The dehydrated fruit puree blend was processed into powder form. The first drying run (zone settings shown in Table 5) represents "baseline" operating conditions where the heating elements across all zones are set at the same distance from the conveyor. In the second drying run (zone settings shown in Table 6), the position of the heaters were kept the same as in drying run 1 but the rate of product applied to the conveyor was increased to increase the capacity of the dryer. In the third drying run (zone settings shown in Table 7), the position of the heaters were manually adjusted prior to dryer operation in order to cause the heaters to emit infrared radiation at or around 6.2 μm (corresponding to peak "C" in FIG. 11). In the fourth drying run (zone settings shown in Table 8), the position of the heaters were manually adjusted prior to dryer operation in order to cause the heaters to emit infrared radiation at or around 7.0 μm (corresponding to peak "D" in FIG. 11). The wavelength of infrared radiation in each zone was determined by measuring the temperature of the heating elements and calculating the wavelength using Wien's law. Table 9 summarizes other operating parameters and characteristics of the product for all four drying runs.

Figure 20:
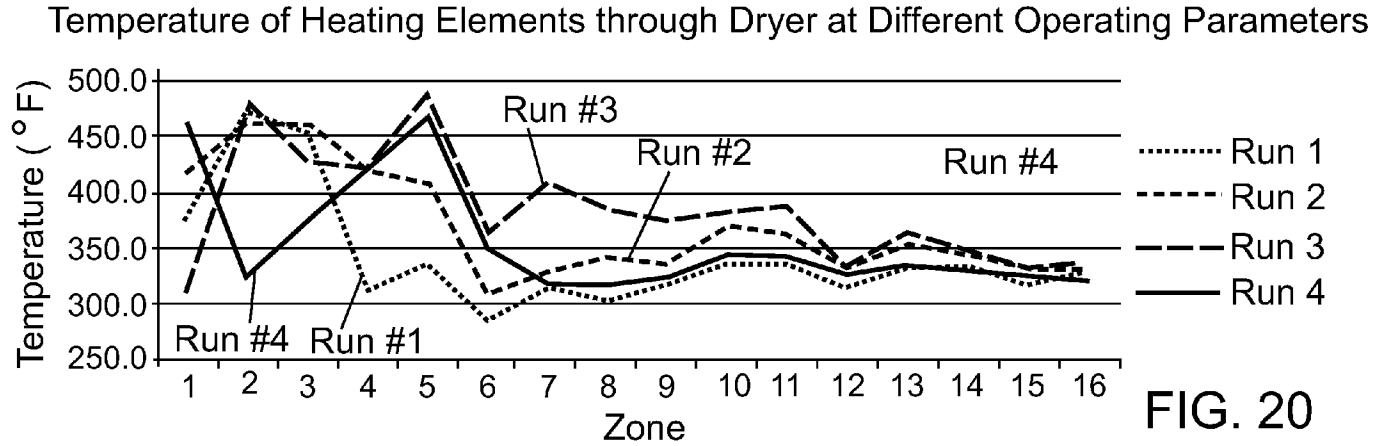
Figure 21:
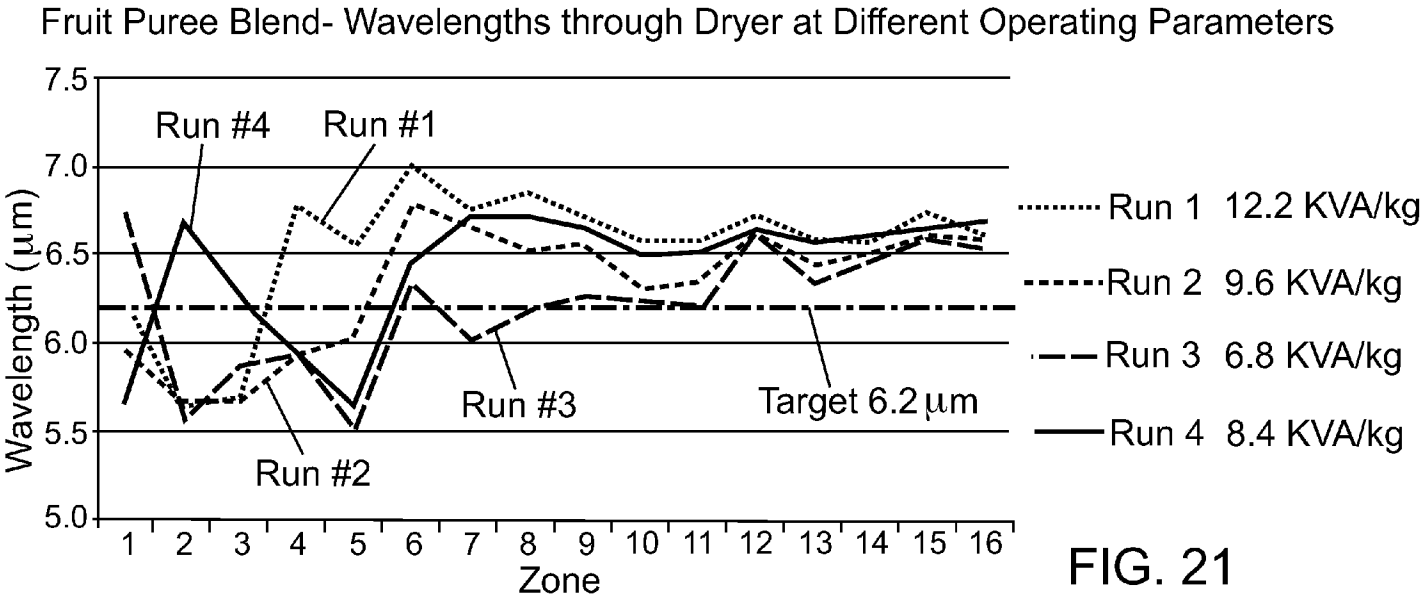
FIG. 21 shows the wavelength of infrared radiation measured in each zone of a dryer under different operating conditions for dehydrating a fruit puree blend.

FIGS. 16, 17, 18, and 19 show the temperature of the heating elements in all zones of the dryer for the first, second, third, and fourth drying runs, respectively. FIG. 20 shows the line graphs of FIGS. 16-19 on one chart. FIG. 21 shows wavelength of IR radiation measured in each zone for all four drying runs.

Table 10 compares the throughput (drying capacity) and the energy usage of all four drying runs. It can be seen from the results of Table 10 that targeting 6.2 μm across all zones (drying run 3) resulted in a 55% increase in drying capacity over the second drying run where the position of the heaters were not adjusted. Drying run 3 also provided the lowest energy consumption per kilogram product dried.

Like Example 1, Example 2 shows that an extremely high product quality can be achieved (as evidenced by the moisture content in all drying runs) by drying the product at the predetermined temperature profile while the drying capacity of the dryer can be increased substantially by operating the heating elements at a predetermined wavelength.

TABLE 5

| Fruit Puree Blend - Baseline | | | | | | | | | | | | | | | | |
|---|---|---|---|---|---|---|---|---|---|---|---|---|---|---|---|---|
| Zone | 1 | 2 | 3 | 4 | 5 | 6 | 7 | 8 | 9 | 10 | 11 | 12 | 13 | 14 | 15 | 16 |
| Product Set Temp (F.) | 110 | 125 | 135 | 145 | 145 | 155 | 165 | 165 | 175 | 175 | 180 | 185 | 185 | 185 | 185 | 185 |
| Avg Heater Temp (F) | 379 | 471 | 454 | 311 | 337 | 286 | 313 | 303 | 317 | 335 | 335 | 317 | 333 | 333 | 317 | 330 |
| Heater distance (in) | 6 | 6 | 6 | 6 | 6 | 6 | 6 | 6 | 6 | 6 | 6 | 6 | 6 | 6 | 6 | 6 |
| Wavelength | 6.2 | 5.6 | 5.7 | 6.8 | 6.6 | 7.0 | 6.7 | 6.8 | 6.7 | 6.6 | 6.6 | 6.7 | 6.6 | 6.6 | 6.7 | 6.6 |

TABLE 6

| Fruit Puree Blend - High Throughput, no Heater Adjustment | | | | | | | | | | | | | | | | |
|---|---|---|---|---|---|---|---|---|---|---|---|---|---|---|---|---|
| Zone | 1 | 2 | 3 | 4 | 5 | 6 | 7 | 8 | 9 | 10 | 11 | 12 | 13 | 14 | 15 | 16 |
| Product Set Temp (F.) | 110 | 125 | 135 | 145 | 145 | 155 | 165 | 165 | 175 | 175 | 180 | 185 | 185 | 185 | 185 | 185 |
| Avg Heater Temp (F.) | 418 | 463 | 460 | 420 | 407.7 | 309 | 328 | 340 | 336 | 368 | 363 | 332 | 352 | 343 | 331 | 333 |
| Heater distance (in) | 6 | 6 | 6 | 6 | 6 | 6 | 6 | 6 | 6 | 6 | 6 | 6 | 6 | 6 | 6 | 6 |
| Wavelength | 5.9 | 5.7 | 5.7 | 5.9 | 6.0 | 6.8 | 6.6 | 6.5 | 6.6 | 6.3 | 6.3 | 6.6 | 6.4 | 6.5 | 6.6 | 6.6 |

TABLE 7

| Fruit Puree Blend - High Throughput, Heaters Adjusted to Peak "C" | | | | | | | | | | | | | | | | |
|---|---|---|---|---|---|---|---|---|---|---|---|---|---|---|---|---|
| Zone | 1 | 2 | 3 | 4 | 5 | 6 | 7 | 8 | 9 | 10 | 11 | 12 | 13 | 14 | 15 | 16 |
| Product Set Temp (F.) | 110 | 125 | 135 | 145 | 145 | 155 | 165 | 165 | 175 | 175 | 180 | 185 | 185 | 185 | 185 | 185 |
| Avg Heater Temp (F.) | 314 | 478 | 429 | 421 | 486 | 365 | 408 | 385 | 374 | 382 | 386 | 330 | 364 | 347 | 333 | 339 |
| Heater distance (in) | 2.9 | 2.9 | 2.4 | 2.4 | 2.9 | 2.9 | 8.9 | 8.9 | 8.9 | 8.9 | 8.9 | 8.9 | 8.4 | 8.4 | 8.4 | 8.4 |
| Wavelength | 6.7 | 5.6 | 5.9 | 5.9 | 5.5 | 6.3 | 6.0 | 6.2 | 6.3 | 6.2 | 6.2 | 6.6 | 6.3 | 6.5 | 6.6 | 6.5 |

TABLE 8

| Fruit Puree Blend - High Throughput, Heaters Adjusted to Peak "D" | | | | | | | | |
|---|---|---|---|---|---|---|---|---|
| Zone | 1 | 2 | 3 | 4 | 5 | 6 | 7 | 8 |
| Product Set Temp (F.) | 110 | 125 | 135 | 145 | 145 | 155 | 165 | 165 |
| Avg Heater Temp (F.) | 463 | 324 | 376 | 421 | 466 | 350 | 318 | 317 |
| Heater distance (in) | 7.75 | 7.75 | 8.75 | 8.75 | 8.75 | 8.75 | 2.625 | 2.625 |
| Wavelength | 5.7 | 6.7 | 6.2 | 5.9 | 5.6 | 6.4 | 6.7 | 6.7 |

TABLE 8-continued

| Fruit Puree Blend - High Throughput, Heaters Adjusted to Peak "D" | | | | | | | | |
|---|---|---|---|---|---|---|---|---|
| Zone | 9 | 10 | 11 | 12 | 13 | 14 | 15 | 16 |
| Product Set Temp (F.) | 175 | 175 | 180 | 185 | 185 | 185 | 185 | 185 |
| Avg Heater Temp (F.) | 324 | 345 | 343 | 326 | 334 | 331 | 326 | 322 |
| Heater distance (in) | 2.875 | 2.875 | 2.375 | 2.375 | 2.375 | 2.375 | 2.625 | 2.625 |
| Wavelength | 6.7 | 6.5 | 6.5 | 6.6 | 6.6 | 6.6 | 6.6 | 6.7 |

TABLE 9

| | Drying Run #1-Baseline | Drying Run #2-High Throughput | Drying Run #3-High Throughput, Heaters Adjusted to Peak "C | Drying Run #4-High Throughput, Heaters Adjusted to Peak "D" |
|---|---|---|---|---|
| Time | 1 hour | 1 hour | 1 hour | 1 hour |
| Ambient conditions | 68.5 F., 45% RH | 68.5 F., 45% RH | 68.5 F., 45% RH | 68.5 F., 45% RH |
| Initial product temp | 41 F. | 41 F. | 41 F. | 41 F. |
| Solids | 30% | 30% | 30% | 30% |
| Average water activity | .324 | .328 | .346 | .343 |
| Average moisture at 104 F. | 2.30% | 2.47% | 2.91% | 2.36% |
| Average moisture at 90 F. | 0.99% | 1.64% | 1.61% | 1.13% |
| Average product thickness (mm) | 0.13 | 0.17 | 0.18 | 0.17 |
| Throughput (kg/hr) | 15.8 | 18.8 | 29.1 | 20.4 |
| Total power (KVA) | 193.1 | 181 | 198 | 170 |
| Power per kg product (KVA/kg) | 12.2 | 9.6 | 6.8 | 8.4 |

TABLE 10

| Results Summary for Fruit Puree Blend | | | |
|---|---|---|---|
| Drying run (fruit puree blend) | Target Wavelength | Throughput (kg/hr) | Energy (KVA) used per kg of product |
| Run 1 - Baseline | None | 15.8 | 12.2 |
| Run 2 - High Throughput | None | 18.8 | 9.6 |
| Run 3 - High Throughput, Heaters Adjusted to Peak "C" | Peak "C" (about 6.2 μm) | 29.1 | 6.8 |
| Run 4 - High Throughput, Heaters Adjusted to Peak "D" | Peak "D" (about 7-8 μm) | 20.4 | 8.4 |

The following factors can affect a dryer's ability to control the wavelength and product temperature within a control zone: (i) the range of adjustment of heating elements towards and away from the support surface of the conveyor belt; (ii) the watt density of the heating elements; (iii) spacing between heating elements; and (iv) the reflector configuration of the heating elements. These features can be optimized within each control zone to maximize dryer capacity and product quality.

If a heating element is too close to the conveyor (e.g., closer than the spacing between individual heating elements), hot/cold areas on the conveyor belt can result if the radius of infrared beams from adjacent heating elements do not overlap as the infrared energy is projected onto the belt. Thus, the minimum distance between the heating elements and the conveyor should be at least equal to or greater than the spacing between individual heating elements. A heating element that is too far away from the conveyor belt will require a relatively high amount of energy to achieve the product temperature at a given wavelength due to the fact that energy density decreases as the square of the distance between the heating element and the conveyor.

The watt density of a heating element can be expressed in watts per inch of the length of the heating element. If the watt density of a heating element is too high, then the heating elements will have to be located very far from the belt to maintain a heater temperature to emit the desired wavelength for a given product temperature. If the watt density of a heating element is too low, then the heating element may need to be too close to the belt, creating hot and cold spots and/or the heating element may not achieve the heater temperature required to achieve the desired wavelength. In order to account for changes in moisture content of the product during drying, the heater watt density and spacing between individual heating elements can be selected based on the moisture content range anticipated in a particular zone, and the anticipated wattage required based on the thermal capacity of the product ($Q=mCp(T1-T2)$) as well as the amount of water vapor produced (1000 BTU/lb. of steam).

Quartz heaters can be clear or frosted and can include a reflector directly on the element or some distance behind the element. For example, each heater support 302, 304, 306, 308 (FIG. 6) can include a reflector (e.g., a metal pan) positioned below the heating elements supported by the heater support.

Heating elements with a reflector on the element itself will have a relatively higher element temperature at the same conditions due to reflection of the bottom infrared directly back at the element itself, resulting in a higher temperature and shorter wavelength at the same power setting compared to a heating element that has a reflector that is positioned below the heating element. If the reflector is below the heating element, more of the initial infrared waves can be reflected around the element. The advantage of reflecting around the element is that there can be a more even distribution of infrared onto the belt, especially in a zone where the heating elements are relatively close to the belt due high removal rate of water (high heat of vaporization). On the other hand, reflectors on the heating elements would be more favorable in control zones where the heaters need to be relatively further away from the belt so as to reduce the maximum distance of the heating elements from the belt, thereby reducing the amount of energy required to achieve the desired wavelength.

Figure 22:
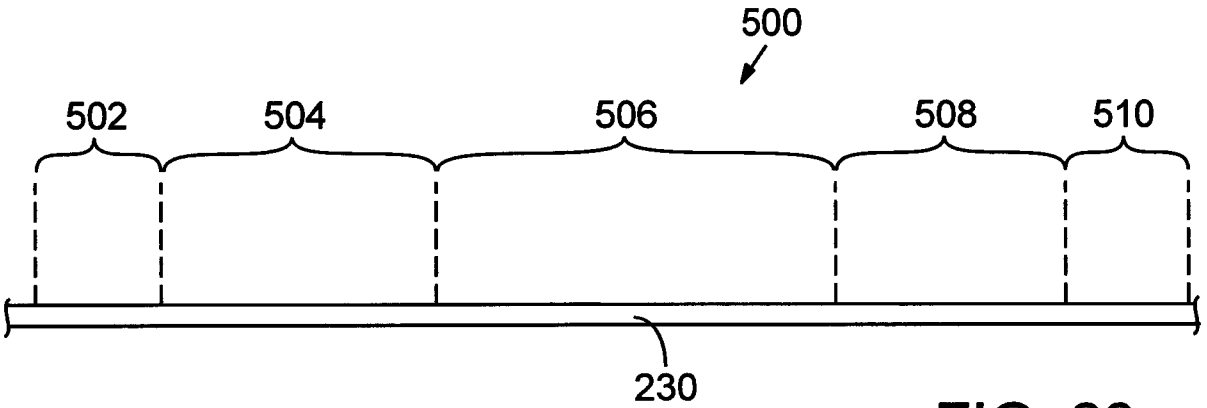
FIG. 22 is a schematic illustration of a drying apparatus, according to another embodiment.

The selection of heater adjustment range, watt density, heater spacing, and reflector configuration can be further explained with reference to FIG. 22. FIG. 22 shows a schematic illustration of a dryer 500 for drying fruit and vegetable liquids (although it can be used for drying other substances). The dryer 500 comprises five main dryer sections 502, 504, 506, 508, and 510. Each dryer section can include one or more control zones. Typically, each control zone comprises a plurality of infrared heating elements (also referred to as infrared emitters or infrared lamps). Within each dryer section, there can be movable heater supports (e.g., 302, 304, 306, 308) that support the heating elements of one control zone, heater supports that support the heating elements of more than one control zone, or a combination of heater supports that support the heating elements of one control zone and heater supports that support the heating elements of more than one control zone. The length of the control zones (in the direction of movement of the conveyor) as well as the length of the movable heater supports can vary along the length of the dryer, for example between one foot and 10 feet. Generally speaking, shorter control zones and shorter heater supports can provide more precise control over product temperature and can be more responsive to changes in thermal properties of the product due to loss of moisture. In particular embodiments, the first dryer section 502 extends about 10% of the overall dryer length; the second dryer section 504 extends about 25% of the overall dryer length; the third dryer section 506 extends about 35% of the overall dryer length; the fourth dryer section 508 extends about 20% of the overall dryer length; and the fifth dryer section 510 extends about 10% of the overall dryer length.

The first dryer section 502 is a "ramp-up" section of the dryer in which the product temperature is increased in a short amount of time to an optimum temperature for most efficient evaporation for the product. In this dryer section, the control zones can be relatively short to increase the product temperature as quickly as possible while avoiding overheating. In particular embodiments, the watt density of the heating elements in this dryer section are in the range of about 20-80 watts/inch, with 50 watts/inch being a specific example. Heater spacing (distance between individual heating elements) is in the range of about 0.5 inch to about 5.0 inch, with 2.0 inch being a specific example. The length of each control zone is in the range of about 6 inches to about 60 inches, with 30 inches being a specific example (each zone having about 15 heating elements). The length of each movable heater support is in the range of about 6 inches to about 60 inches, with 30 inches being a specific example. In a specific implementation, each movable heater support can support the heating elements of one control zone (such as shown in FIG. 6). The distance between the heating elements and the conveyor 230 within the first dryer section 502 can be adjusted between about 0.5 inch and 5.0 inches, with 2.0 inches being a specific operating distance. Reflectors mounted below the heating elements can be used in this dryer section.

The second dryer section 504 is a high evaporation section in which the moisture content is initially high, and the product is maintained at an efficient temperature for moisture evaporation. In this section, the process is generally at a steady state evaporating a large amount of moisture with little effect on product temperature. Accordingly, the control zones can be relatively longer in this dryer section. A relatively large amount of energy is required in this dryer section. In particular embodiments, the watt density of the heating elements in this dryer section are in the range of about 20-80 watts/inch, with 60 watts/inch being a specific example. Heater spacing (distance between individual heating elements) is in the range of about 0.5 inch to about 5.0 inch, with 2.0 inch being a specific example. The length of each control zone is in the range of about 15 inches to about 120 inches, with 60 inches being a specific example (each zone having about 30 heating elements). The length of each movable heater support is in the range of about 15 inches to about 240 inches, with 120 inches being a specific example. In a specific implementation, each movable heater support can support the heating elements of two control zones. The distance between the heating elements and the conveyor 230 within the second dryer section 504 can be adjusted between about 0.5 inch and 5.0 inches, with 2.0 inches being a specific operating distance. Reflectors mounted below the heating elements can be used in this dryer section.

The third dryer section 506 is a transition section in which the product transitions into a mostly dry state and becomes very heat sensitive. Accordingly, the lengths of the control zones desirably are relatively shorter in this dryer section to respond to any fluctuations in product characteristics that affect the drying rate. In particular embodiments, the watt density of the heating elements in this dryer section are in the range of about 20-60 watts/inch, with 30 watts/inch being a specific example. Heater spacing (distance between individual heating elements) is in the range of about 0.5 inch to about 24.0 inch, with 3.0 inch being a specific example. The length of each control zone is in the range of about 15 inches to about 120 inches, with 30 inches being a specific example (each zone having about 10 heating elements). The length of each movable heater support is in the range of about 15 inches to about 240 inches, with 30 inches being a specific example. In a specific implementation, each movable heater support can support the heating elements of one control zone. The distance between the heating elements and the conveyor 230 within the third dryer section 506 can be adjusted between about 0.5 inch and 24.0 inches, and more specifically between about 4.0 inches to about 10 inches. In this drying section, a combination of reflectors mounted below the heating elements and heating elements having integral reflectors can be used.

The fourth drying section 508 is a final drying section where the product initially is mostly dry and the control zones are relatively longer to remove the last moisture from the product under relatively steady state conditions. Longer control zones are desirable to maintain substantially constant drying. In particular embodiments, the watt density of the heating elements in this dryer section are in the range of about 20-80 watts/inch, with 60 watts/inch being a specific example. Heater spacing (distance between individual heating elements) is in the range of about 0.5 inch to about 5.0 inch, with 4.0 inch being a specific example. The length of each control zone is in the range of about 60 inches to about 120 inches, with 90 inches being a specific example (each zone having about 22 heating elements). The length of each movable heater support is in the range of about 15 inches to about 240 inches, with 120 inches being a specific example. In a specific implementation, some of the movable heater supports can support the heating elements of one control zone while other movable heater supports can support the heating elements of two control zones. The distance between the heating elements and the conveyor 230 within the fourth dryer section 508 can be adjusted between about 0.5 inch and 20.0 inches, with 16 inches being a specific operating distance. Heating elements having integral reflectors can be used in this drying section.

The fifth drying section 510 is an exit or "ramp-down" section where the control zones can be relatively short to reduce the product temperature for annealing and/or to avoid overheating a particularly heat sensitive product. In particular embodiments, the watt density of the heating elements in this dryer section are about 10 watts/inch. Heater spacing (distance between individual heating elements) is in the range of about 0.5 inch to about 5.0 inch, with 3.0 inch being a specific example. The length of each control zone is in the range of about 60 inches to about 120 inches, with 30 inches being a specific example (each zone having about 10 heating elements). The length of each movable heater support is in the range of about 15 inches to about 120 inches, with 30 inches being a specific example. In a specific implementation, each movable heater support can support the heating elements of one control zone. The distance between the heating elements and the conveyor 230 within the fifth dryer section 510 can be adjusted between about 0.5 inch and 15.0 inches, with 10 inches being a specific operating distance. Heating elements having integral reflectors can be used in this drying section.

In a specific implementation, a dryer 500 has an overall length of about 100 feet. The first dryer section 502 has four control zones, each of which is about 30 inches in length and is mounted on a respective movable heater support. The second dryer section 504 has five control zones, each of which is about 60 inches in length, and ten movable heater supports, each supporting two control zones. The third dryer section 506 has fourteen control zones, each of which is about 30 inches in length and is mounted on a respective movable heater support. The fourth dryer section 508 has three control zones, each of which is about 90 inches in length. The fourth dryer section 508 can include movable heater supports that support one control zone and heater supports that support more than one control zone. The fifth dryer section 510 has four control zones, each of which is about 30 inches in length and is mounted on a respective movable heater support.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

I claim:

1. A drying apparatus comprising:

a movable product conveyor having a product support surface for supporting a product to be dried;

at least first and second heater supports, each heater support supporting one or more dry radiant heating elements and being movable relative to each other and relative to the conveyor to adjust the distance between each heater support and the conveyor;

the product conveyor being configured to move relative to the first and second heater supports such that the product supported on the conveyor is successively heated by the heating elements of the first heater support and the heating elements of the second heater supports; and a controller configured to adjust the temperature of the heating elements of each heater support and the distance between the heating elements of each heater support and the conveyor such that the heating elements emit radiant heat at a predetermined wavelength and heat the product according to a predetermined product temperature profile, wherein the controller is configured to operate in first and second feedback loops, such that in the first feedback loop, the controller monitors the temperature of the product and adjusts the temperature of the heating elements, and in the second feedback loop, the controller monitors the wavelength of the heating elements and adjusts the distance between the heating elements and the conveyor such that the heating elements heat the product according to the predetermined product temperature profile and maintain the predetermined wavelength;

a plurality of temperature sensors positioned to measure the temperature of the heating elements of each heater support, the controller being in communication with the temperature sensors and being configured to determine the wavelength of radiant heat emitted by the heating elements based on their temperature.

2. The drying apparatus of claim 1, wherein the controller comprises at least a first phase angle control device that controls the temperature of the heating elements of the first heater support and a second phase angle control device that controls the temperature of the heating elements of the second heater support.

3. The drying apparatus of claim 1, wherein each heater support is supported by a plurality of upright support posts and is movable upwardly and downwardly relative to the support posts.

4. The drying apparatus of claim 3, wherein each heater support comprises at least one drive mechanism that causes the heater support to move upwardly and downwardly relative to the support posts.

5. The drying apparatus of claim 1, wherein the heater supports are located below the product support surface and are movable upwardly and downwardly toward and away from the product support surface.

6. The drying apparatus of claim 1, wherein the controller is configured to adjust the temperature of the heating elements of each heater support and the distance between the heating elements of each heater support and the conveyor such that the product adsorbs radiant heat at a substantially constant wavelength as it is conveyed past the heating elements of the first and second heater supports.

7. The drying apparatus of claim 1, further comprising a plurality of temperature sensors positioned to measure the temperature of the product being heated by the heating elements, the controller being in communication with the temperature sensors and being configured to adjust the temperature of the heating elements based on feedback from the temperature sensors to maintain the predetermined product temperature profile.

8. A method of drying a product, comprising:

applying a product to be dried onto a product support surface of a movable conveyor;

conveying the product on the conveyor through at least a first heating zone and a second heating zone;

heating the product with a first set of one or more dry radiant heating elements in the first heating zone and heating the product with a second set of one or more dry radiant heating elements in the second heating zone;

as the conveyor conveys the product through the first and second heating zones, adjusting the temperature of the heating elements and the distance between each set of heating elements and the product support surface to heat the product at a predetermined temperature profile and to cause the heating elements to emit radiant heat at a predetermined wavelength; and measuring the temperature of the product in the first and second heating zones, determining the wavelength of the radiant heat emitted by the heating elements in the first and second heating zones, and adjusting the temperature of the heating elements and the distance between each set of heating elements and the product support surface based on the measured temperatures and the determined wavelengths so as to heat the product at the predetermined temperature profile and to cause the heating elements to emit radiant heat at the predetermined wavelength;

wherein determining the wavelength of the radiant heat emitted by the heating elements in the first and second heating zones comprises measuring the temperature of the heating elements in the first and second heating zones and determining the wavelength of the radiant heat in the first and second heating zones based on the measured temperatures of the heating elements.

9. The method of claim 8, wherein the heating elements are located below the product support surface and the act of adjusting the distance between each set of heating elements and the product support surface comprises moving each set of heating elements upwardly or downwardly relative to the product support surface.

10. The method of claim 8, wherein the temperature of the heating elements and the distance between each set of heating elements and the product support surface are adjusted to maintain a substantially constant product temperature in the first and second heating zones and such that wavelength of radiant heat emitted in the first and second heating zones is substantially constant.

11. The method of claim 8, wherein the temperature of the heating elements and the distance between each set of heating elements and the product support surface are adjusted such that the product temperature in the second heating zone is greater than in the first heating zone and such that wavelength of radiant heat emitted in the first and second heating zones is substantially constant.

12. The method of claim 8, wherein the heating elements in the first and second heating zones emit infrared radiation at about 3 μm.

13. The method of claim 8, wherein the heating elements in the first and second heating zones emit infrared radiation at about 6.2 μm.

14. The method of claim 8, wherein the temperature of the heating elements in each zone is adjusted by controlling a phase angle control device that modulates the amount of electrical energy supplied to the heating elements.

15. The method of claim 8, wherein the product comprises a fruit or vegetable liquid and the act of heating the product comprises substantially dehydrating the fruit or vegetable liquid.

16. The method of claim 15, further comprising processing the dehydrated fruit or vegetable liquid into a powder.

* * * * *